US008579174B2

(12) United States Patent
Ueno et al.

(10) Patent No.: US 8,579,174 B2
(45) Date of Patent: Nov. 12, 2013

(54) TAG ATTACHING PIN ATTACHING APPARATUS

(75) Inventors: Hideyuki Ueno, Yokohama (JP); Hitoshi Fujiwara, Shiojiri (JP)

(73) Assignee: M.I.T. International Co., Ltd., Yokohama-shi (JP)

( * ) Notice: Subject to any disclaimer, the term of this patent is extended or adjusted under 35 U.S.C. 154(b) by 188 days.

(21) Appl. No.: 12/994,681

(22) PCT Filed: May 27, 2009

(86) PCT No.: PCT/JP2009/060104

§ 371 (c)(1),
(2), (4) Date: Nov. 24, 2010

(87) PCT Pub. No.: WO2009/145350

PCT Pub. Date: Dec. 3, 2009

(65) Prior Publication Data

US 2011/0084110 A1 Apr. 14, 2011

(30) Foreign Application Priority Data

May 28, 2008 (JP) ..... 2008-139138
Nov. 26, 2008 (JP) ..... 2008-300701
Mar. 30, 2009 (JP) ..... 2009-081028

(51) Int. Cl.
*A43D 69/00* (2006.01)

(52) U.S. Cl.
USPC ..... 227/67

(58) Field of Classification Search
USPC ..... 227/24–50, 67, 140, 156
See application file for complete search history.

(56) References Cited

U.S. PATENT DOCUMENTS 3,641,804 A * 2/1972 Oudenhoven ..... 72/409.01
4,060,089 A * 11/1977 Noiles ..... 606/220
4,445,882 A * 5/1984 Ueno ..... 493/376
4,487,354 A * 12/1984 Ueno ..... 227/67
4,511,073 A * 4/1985 Furutsu ..... 227/67

(Continued)

FOREIGN PATENT DOCUMENTS

JP 58-123470 8/1983
JP 4-209 1/1992

(Continued)

OTHER PUBLICATIONS

International Search Report issued in PCT/JP2009/060104, dated Jul. 14, 2009.

*Primary Examiner* — Robert Long
(74) *Attorney, Agent, or Firm* — Greer, Burns & Crain, Ltd.

(57) ABSTRACT

A tag-attaching pin attaching apparatus is used with a tag-attaching pin unit which is formed with a plurality of tag-attaching pins each having an insertion head section and a holding section both of which are provided on both end portions of a fiber section. The plurality of tag-attaching pins are mutually and adjacently arranged in parallel and connected with each other via connecting members. The tag-attaching pin attaching apparatus of the present invention is configured so that under a situation in which one of an end portion of the tag-attaching pin unit, without using any connecting bars, is arranged at an insertion head portion shooting out position, a tag-attaching pin unit pushing member applies a bias force directing to the insertion head portion shooting out position, to another end portion of the tag-attaching pin unit.

33 Claims, 19 Drawing Sheets

(56) References Cited

U.S. PATENT DOCUMENTS

| | | | | | |
|---|---|---|---|---|---|
| 4,535,926 | A | * | 8/1985 | Furutsu | 227/67 |
| 4,538,754 | A | * | 9/1985 | Furutsu | 227/67 |
| 4,592,500 | A | * | 6/1986 | Kato | 227/67 |
| 4,610,250 | A | * | 9/1986 | Green | 606/220 |
| 4,696,422 | A | * | 9/1987 | Strausburg | 227/39 |
| 4,715,521 | A | * | 12/1987 | Strausburg | 227/67 |
| 4,785,987 | A | * | 11/1988 | Strausburg | 227/67 |
| 4,838,469 | A | * | 6/1989 | Strausburg | 227/67 |
| 4,923,106 | A | * | 5/1990 | Furutsu | 227/67 |
| 4,969,589 | A | * | 11/1990 | Kim | 227/67 |
| 4,971,238 | A | * | 11/1990 | Furutsu | 227/2 |
| 5,038,931 | A | * | 8/1991 | Kunreuther | 206/346 |
| 5,074,452 | A | * | 12/1991 | Bone | 227/67 |
| 5,360,153 | A | * | 11/1994 | Cooper | 227/67 |
| 5,388,748 | A | * | 2/1995 | Davignon et al. | 227/67 |
| 5,388,749 | A | * | 2/1995 | Davignon et al. | 227/67 |
| RE34,891 | E | * | 4/1995 | Kunreuther | 206/346 |
| 5,472,131 | A | * | 12/1995 | Kubota | 227/67 |
| 5,497,930 | A | | 3/1996 | Kubota | |
| 5,529,233 | A | * | 6/1996 | Davignon et al. | 227/67 |
| 5,669,543 | A | * | 9/1997 | Ueno | 227/67 |
| 5,738,265 | A | | 4/1998 | Hirai et al. | |
| 5,845,835 | A | * | 12/1998 | Kim | 227/67 |
| 5,878,935 | A | * | 3/1999 | Furutsu | 227/67 |
| 6,240,606 | B1 | * | 6/2001 | Hiroki | 24/704.1 |
| 6,796,479 | B2 | * | 9/2004 | Ueno | 227/71 |
| 6,929,166 | B2 | * | 8/2005 | Furutsu | 227/67 |
| 7,380,694 | B2 | * | 6/2008 | Ueno | 227/67 |
| 7,758,612 | B2 | * | 7/2010 | Shipp | 606/219 |
| 7,828,183 | B2 | * | 11/2010 | Furutsu | 227/67 |
| 2003/0164393 | A1 | * | 9/2003 | Ueno et al. | 227/67 |
| 2008/0302851 | A1 | * | 12/2008 | Ueno | 227/120 |
| 2010/0019014 | A1 | * | 1/2010 | Rodenhouse | 227/32 |
| 2012/0241490 | A1 | * | 9/2012 | Busch et al. | 227/76 |

FOREIGN PATENT DOCUMENTS

| | | | | | |
|---|---|---|---|---|---|
| JP | 2000-33922 | | | 2/2000 | |
| JP | 2000033922 | A | * | 2/2000 | B65C 5/00 |
| JP | 2003-195770 | | | 7/2003 | |

* cited by examiner (A)

(B)

(A) (B)

(A)

(B)

(A)

(B)

(C)

(A)

(B)

TAG ATTACHING PIN ATTACHING APPARATUS

FIELD OF THE INVENTION

The present invention relates to a tag-attaching attaching apparatus which can shot a tag-attaching pin which can bind clothes, socks, or the like or which can attach tags such as brand labels, price tags, material description, instructions or the like to a good by inserting one end portion of the tag-attaching pin into the good.

BACKGROUND OF THE INVENTION

In general, in order to bind clothes, daily small articles, sandals, shoes or the like or to efficiently attach brand labels, price tags or the like to relevant products, various kinds of tag attaching device have been used in the past.

One embodiment of a specific configuration of a conventional tag attaching pin is shown in FIG. 4.

As shown in FIG. 9, the tag attaching pin 1 comprises a desired fiber section 4, an insertion head section 2 provided at one end portion of the fiber section 4 and a holding section 3 provided at the another end of the fiber section 4 and which can hold a tag 5 thereon, and the tag attaching pin 1 is made of a suitable synthetic resin material and all of the above-mentioned sections are integrally molded into one body.

As shown in FIG. 10, by utilizing a hollow needle 21, the fiber section 4 of the tag-attaching pin 1 is inserted into a hole 6 which had been previously provided on the tag 5 and then the insertion head section 2 of the tag-attaching pin 1 with the tag 5 held thereon, is penetrated through a desired portion of a desired good 10 by inserting the hollow needle 21 into the good 10, so that the tag-attaching pin 1 is engaged with the good 10.

On the other hand, the above-mentioned tag-attaching pin 1 is provided so that, for example, the inserting head section 2, the holding section 3 and the fiber section 4 are made of a synthetic resin material such as ordinal nylon resin, polyester resin, polypropylene resin or the like and all of these sections are integrally molded into one body.

On the other hand, for example, the above-mentioned tag-attaching pin 1 is used with the tag-attaching pin attaching apparatus 20 as shown in the Japanese unexamined patent publication (KOKAI) No. 11-143367 (Patent Document No. 1) and FIG. 4.

Note that the tag-attaching pin attaching apparatus 20 has been already known and called as a shooting gun, whereby the above-mentioned tag-attaching pin 1 can be attached to a good and wherein the tag-attaching pin attaching apparatus 20 comprises a hollow needle 21 to be penetrated through a desired good so as to engage the insertion head section 2 of the tag-attaching pin 1 with a back side surface of the good and by operating a suitable pin shooting means 42, the insertion head section 2 of the tag-attaching pin 1 is inserted into the hollow needle 21 and then the insertion head section 2 is pushed out from the hollow needle 21 utilizing a suitable pin pushing-out means so as to have the insertion head section 2 of the tag-attaching pin engaged with the good.

In this embodiment, it is preferable that the tag-attaching pin 1 can be shot out from the tag-attaching pin attaching apparatus 20 one by one or as shown in FIG. 5(A), it is also preferable that a plurality of the tag-attaching pin 1 are arranged in parallelism with each other and they are simultaneously connected to a suitable connecting member such as a runner bar 24 via a respective suitable connecting member 11 so as to form a sheet like tag-attaching pin unite 600, and as shown in FIG. 5(B), the integrally assembled tag-attaching pin unit 600 is mounted on the apparatus 20 by inserting the connecting bar 24 into an insertion portion 40 and the insertion head section 2 into an insertion groove portion 32 both of the insertion portion 40 and the insertion groove portion 32 being provided on a top end surface of the tag-attaching pin attaching apparatus 20, so as to enable each one of the tag-attaching pins 1 to be successively shot individually into a predetermined good, respectively so that in that a tag can be attached to the good, as shown in FIG. 4.

On the other hand, as one embodiment of the shooting pin mechanism for shooting the tag-attaching pin 10 used for the tag-attaching pin attaching apparatus 20, a tag-attaching pin attaching apparatus as shown in, for example, the Japanese unexamined patent publication (KOKAI) No. 6-263127 (Patent Document No. 2) or the Japanese unexamined patent publication (KOKAI) No. 2000-33922 (Patent Document No. 3) is known in which as shown in FIG. 4, a shooting pin 42 which is driven by a mechanism as shown in FIG. 6, is arranged at a side portion of a vertical groove and by operating an operation lever 22, the insertion head portion 3 is cut our from a connecting portion 11 provided on the connecting bar 24 and is pushed out forwardly along a cylindrical hollow needle 21 one by one.

A mechanism for shooting out the insertion head section 2 to the hollow needle 21 of the conventional tag-attaching pin attaching apparatus 20 will be explained more precisely hereunder.

FIG. 6(A) shows one specific embodiment of the shooting out mechanism used for the inserting head section of the conventional tag-attaching pin attaching apparatus 20 and more precisely, as shown in FIGS. 6(A) and 6(B), the tag-attaching pin attaching apparatus 20 is provided with a hollow needle fixing section 202 for holding the hollow needle 21 which is provided on a tip end portion 201 of the tag-attaching pin attaching apparatus 20, a shooting means 43 that is a shooting pin section 43, which can push out the insertion head portion 2 into a hollow needle 21 and which is arranged on a position opposite to the hollow needle fixing section 202, and an insertion head portion shooting out position 203 which is provided at a position formed between the hollow needle fixing section 202 and the shooting pin section 43 in which a tip end portion of the shooting pin 42 is arranged, and wherein the tag-attaching pin attaching apparatus 20 is configured so that by operating the operation lever 22, one of the end portions 208 of the connecting lever 207 can be pivoted around a supporting rod 206 being connected to the operation lever 22 so that the shooting pin 42 of the shooting pin portion 43 can push out the insertion head section 2 which is waiting at the insertion head portion shooting out position 203 thereby the insertion head section 2 is passed through the inside portion of the hollow needle 21.

Note that, an example of the configuration of the conventional hollow needle 21 is shown, for example, in Japanese unexamined patent publication (KOKAI) No. 8-171349 (Patent Document No. 4), in which a hollow needle is provided with a groove portion 204 being formed on a side surface thereof, through which a fiber section 4 of the tag-attaching pin 1 is slidably moved and further, at a rear end portion of the hollow needle 21, an optional cutter member 70 as shown in FIGS. 6(A) and 6(B) is arranged.

Note that, in the above-mentioned conventional technology, when tag-attaching pin unit 600 comprising a plurality of the tag-attaching pins 1 each being arranged mutually and in parallelism with each other by the connection bars 24, is mounted on an upper surface of the tag-attaching pin attaching apparatus 20, the inserting head section 2 and the connection bar 24 of the tag-attaching pin 1 are inserted into an insertion groove 32 for the inserting head section 2 and an insertion groove 40 for the connection bar 24, respectively, and as shown in FIG. 5, under a condition in which the tag-attaching pin unit 600 is extended upwardly over the upper surface of the tag-attaching pin attaching apparatus 20, an operation to shoot the respective tag-attaching pin 1 one by one, is performed.

In this embodiment, although the tag-attaching pin unit 600 is held upwardly over the upper surface of the tag-attaching pin attaching apparatus 20, in a stable condition, by the connection bar 24, when the length of the tag-attaching pin unit 600 is enlarged, the tag-attaching pin unit 600 fluctuate so as to make the pin shooting operation starts unstable.

And further, an extended portion of the tag-attaching pin unit 600 extended over the upper surface of the tag-attaching pin attaching apparatus 20, per se will become an obstacle for the pin shooing operation.

For the sake of this, as shown in the Japanese unexamined patent publication (KOKAI) No. 11-143367 (Patent Document No. 1), and FIG. 7 of the present invention, a technology, in which an arranging configuration controlling guide means 222 for the tag-attaching pin unit 600 is provided on an upper surface of the tag-attaching pin attaching apparatus 20 so as to limit a projection height of the tag-attaching pin unit 600 measured from the upper surface of the tag-attaching pin attaching apparatus 20 as well as to hold the tag-attaching pin unit 600 stably to prevent the fluctuation of the tag-attaching pin unit 600 from being obstacle for the pin shooing operation, is adopted.

Further in the past technology, when the pin shooting operation is performed, each one of the tag-attaching pin 1 is detached from the connecting portion 11 provided on the connection bar 24, respectively, by a cutter or the like which is arranged on a suitable portion in the hollow needle 21.

Accordingly, as shown in FIG. 6(B), the connection bar 24 is exhausted from an opening provided on a lower portion or a rear portion of the tag-attaching pin attaching apparatus 20 with the connection portion 11 but this kind of connection bar 24 becomes useless at this stage and thus it is disposed as an industrial waste.

That means that although, the conventional tag-attaching pin unit 600 has been effective since the connection bar 24 has apparently contributed to keep the working configuration of the tag-attaching pin unit 600 stable, it must be treated as the industrial waste, ultimately, and thus the connection bat 24 per se, becomes an over-spec of the tag-attaching pin unit 600 leading the law materials to be wasted.

Therefore, this situation would contribute to increase the production cost for the tag-attaching pin unit 600 as well as to contribute to waste an additional cost and energy due to the specific treatment for such industrial waste.

It is apparent that this situation would raise a problem for environmental safe guard measures and it also becomes a retrograded movement against the movement for reducing an exhaustion of CO2.

On the other hand, in the conventional tag-attaching pin attaching apparatus 20, since the tag-attaching pin unit 600 which has the connection bar 24 is used, it is necessary for each one of the inserting head section 2 of the respective tag-attaching pin 1 to be surely arranged at a necessary position in the insertion head portion shooting out position 203, by a time just immediately before the respective tag-attaching pin 1 is shot out.

For the sake of it, for example, a tag-attaching pin attaching apparatus 20 is shown in the Japanese unexamined patent publication (KOKAI) No. 6-263127 (Patent Document No. 2) and FIG. 8 of the present application and in which a needle portion 180 which can be swung up and down directions in response to a movement of the operation lever 22 of the tag-attaching pin attaching apparatus 20 is used and further, a pin feeding mechanism which can force each one of the inserting head section 2 of the tag-attaching pin 1 to be moved down-wardly, one by one, by engaging the needle portion 180 with the connection member 11 connecting the connection bar 24 to each one of the tag-attaching pin 1 of the tag-attaching pin unit 600, intermittently or a separate feeding mechanism in which a suitable rotating gear is provided instead of the swingable needle portion 180, can be used.

However, any one of the pin feeding mechanism for the inserting head section 2 has a complicated mechanism and the number of the constructing element thereof is high and accordingly there have been a lots of problems in which a malfunctions over this mechanism have been frequently arisen or working efficiency of an assembling step in over all producing steps has been reduced or the like.

Finally, these problems have contributed to increase the production costs and the maintenance cost.

DISCLOSURE OF THE INVENTION

By the effect of the recent global warming effect, recently, the kinds or the designs of the object goods to which the tag-attaching pin 1 can be used, have been greatly changed, for example, the number of the goods such as an over-coat, a thick jacket, a thick shirt, a thick sweater, a thick under shirt, a thick sock or the like, have been reduced, on the other hand, the number of goods which have been light-weighted or which having a thin thickness have been increased.

As the result thereof, since the number of the target goods for which the conventionally used tag-attaching pin 1 is seemed to have an over specification, if it would be used, has been increased, the time has come when the specification of the tag-attaching pin 1 per se should be reconsidered.

Therefore, a minimized, light-weighted or low cost tag-attaching pin 1 has been expected to be produced as well as a new type of the tag-attaching pin 1 which can contribute to the resource saving or to suppress a generation of the industrial waste as well as to suppress a generation of CO2 is expected to be developed and used.

The inventors of this application have reviewed eagerly about these problems and finally they have developed a tag-attaching pin 1 which contributes to suppress the generation of the industrial waste and to suppress the generation of CO2 and which can overcome the above-mentioned conventional problems by reconsidering the over-specification portion of the conventional tag-attaching pin 1 and by seeking to produce a light-weighted, the resource saving or low-cost tag-attaching pin 1.

And further, the inventors of this application has developed the tag-attaching pin attaching apparatus 20 which can dedicatedly use the tag-attaching pin 1 which is eco-friendly and which can contribute to realize the resource saving and to produce it with low cost further the pin shooting operation of which being effective.

Accordingly, the object of the present invention is to provide a tag-attaching pin which can realize to produce the light weighted, the resource saving or low cost tag-attaching pin as well as to contribute to reduce the exhaustion of CO2, and also to provide a tag-attaching pin attaching apparatus which can dedicatedly use the above-mentioned tag-attaching pin.

First of all, the inventors of this application has reconsidered about the configuration and the mechanism of the conventional tag-attaching pin 1 and the conventional tag-attaching pin unit 600, taking the recent environment changes into account.

As the results thereof, they have developed an eco-type tag-attaching pin unit 600 which having sufficient configuration holding function nevertheless it is not provided with a runner bar, such as the connection bar 24 and which is prevented from being unstably fluctuated in the operation period so that the operation efficiency of which being sophisticated due to such sufficient stableness thereof and further which can realize the resource saving by reducing the amount of law materials to be used in its production steps as well as can realize to minimize the environmental contamination and to greatly reduce the production cost thereof.

In addition thereto, the inventors of this application make it possible to provide the tag-attaching pin unit 600 which can contribute to the resource saving, by using a fiber section 4 made of fine fiber comparing with a filament which has been used for the filament section in the conventional tag-attaching pin 1 and by using the inserting head section 2 comprising a lateral rod member having a diameter being finer than that of the lateral rod member such as the inserting head section, which has been used for the conventional tag-attaching pin 1, and further by commonly using a holding section 3 the sectional area of which being smaller than that of the holding section used in the conventional tag-attaching pin 1.

It can be designed that a diameter of the fiber section of the tag-attaching pin 1 of the present invention can be shortened from that of the filament section as used in the conventional tag-attaching pin 1, for example, by about 50% so as to use a more finer fiber comparing with the conventional filament.

Further, the area of the holding section 3 of the tag-attaching pin 1 of the present invention, can also be designed to have the one being smaller than that of the holding section of the conventional tag-attaching pin 1, for example, by 50% smaller than that of the conventional one.

An embodiment of a configuration of the tag-attaching pin 1 which having a new configuration and which can be used in the present invention and an embodiment of a configuration of the tag-attaching pin unit 600 which comprises a plurality of the above-mentioned tag-attaching pins 1 each being arranged in parallelism with each other so as to form an integrated body, are shown in FIG. 3.

As shown by FIG. 3, the tag-attaching pin unit 600 comprises a plurality of the tag-attaching pins 1 each comprising a holding section 3, a fiber section 4 connecting to the holding section 3 and a insertion head section 2 which is perpendicularly arranged to the fiber section 4 and which is connected to one end portion of the fiber section 4 which being opposite to another end portion thereof to which the holding section 3 is connected, and wherein the tag-attaching pin unit 600 shows a construction body in which the above-mentioned plurality of tag-attaching pins 1 are assembled without using the connection bar 24 so that the plurality of the holding sections 3 are mutually and adjacently arranged in parallelism with each other and the plurality of the insertion head section 2 are also mutually and adjacently arranged in parallelism with each other, and further wherein the tag-attaching pin unit 600 is configured so that between the holding sections 3 each being mutually and adjacently arranged with each other, there is provided a first connection member 7 which can fixedly connect the adjacently arranged holding sections 2 with each other, while between the insertion head sections 2, each being mutually and adjacently arranged with each other and on a position locating on a center portion of the insertion head section 3 with respect to a longitudinal direction thereof, there is provided a second connection member 8 which can fixedly connect the adjacently arranged insertion head section 2 with each other.

The first connection member 7 and the second connection member 8 as used in the present invention may have the configuration being identical to each other, and the specific configuration thereof may be any one of a rod like member, a cylindrical member or a film like member having a predetermined width as shown in FIG. 3(B), or may be a corn like member as shown in FIG. 3(C) so that a steep tip portion 122 thereof can make a point contact with the adjacently arranged insertion head section 2.

Note that in the present invention, the first and the second connection members 7 and 8 may have the configuration being identical to each other or may have the configuration each being different from each other but it is desirable that these connection members 7 and 8 should have a configuration which being finer or shorter or thinner than that of the conventional connection member.

As another embodiment of the connection member 8 of the present invention, as shown in FIG. 3(D), the connection member 8 may have a configuration in which the cylindrical connection member 8 is obliquely arranged between two adjacently arranged insertion head sections 2 and by adopting this configuration, the connection portion can be easily cut out so that the efficiency of the cutting operation can be improved.

On the other hand, as a separate embodiment of the connection member 8 of the present invention, as shown in FIG. 3(E), the connection member 8 may have a configuration in which the cylindrical connection member 8 is provided with a steep tip end portion 122 on both end portion of the main body portion 8.

Therefore, due to the above-mentioned configuration, the tag-attaching pin unit 600 of the present invention has a characteristic, in that it can be soft and easy bendable comparing with those of the conventional tag-attaching pin unit as well as each one of the tag-attaching pins can be easily separated from the tag-attaching pin unit 600, respectively without using a cutting member such as a cutter or the like as used in the conventional tag-attaching pin attaching apparatus.

On the other hand, as shown in FIG. 3, when a cutter 70 is used in the present invention, the first connection member 7 may have a connection power level whereby the first connection member 7 can be easily broken with a manual operation or with a slight shearing force and on the other hand, the second connection member 8 may comprise a member having a cylindrical configuration with relatively larger diameter or a member having a film like or a plate like configuration with a predetermined length covering around a center portion of the inserting head section 2.

By adopting these configurations, the tag-attaching pin unit 600 does not fluctuate during its operation and further a generation of entanglement of the fibers 4 can be effectively prevented when the unit 600 is packaged or is taken out from the package in a distribution channel.

Note that, the tag-attaching pin attaching apparatus 20 of the present invention is configured so that it can use all kind of tag-attaching pin unit 600 having any kind of constructions as mentioned above, and thus the very important point of the present invention is such that the sheet like tag-attaching pin unit can be continuously maintained in a stable condition during the pin shooting operation on the tag-attaching pin attaching apparatus, without showing any unstable fluctuation or deformation of the sheet like tag-attaching pin unit during the pin shooting operation even though a length of the sheet like tag-attaching pin unit is prolonged, nevertheless the sheet like tag-attaching pin unit is not provided with a runner bar.

Therefore, in the present invention, the shooting operation can be performed surely and smoothly so that an operation efficiency of the present invention can become high and addition thereto, since the amount of the law materials to be used in the tag-attaching pin unit is small, the present invention can meet with the resource saving and simultaneously with this, the present invention contributes to a reduction of exhaustion of CO2.

Accordingly, an eco-type tag-attaching pin unit with eco-friendly and low production cost, can be easily produced.

Further, taking the above-mentioned environmental problems into account, the inventors of the present inventions has completed a tag-attaching pin unit made of polypropylene resin, without using a runner bar and in which a plurality of tag-attaching pins each having a specification of 5 to 50 mm in height, 8.0 to 10.0 mm in width, 50 to 200 mm in length, 0.4 to 0.6 mm in a diameter of the fiber, are arranged in parallelism with each other with high density of 1.2 to 1.5 mm pitch.

The tag-attaching pin unit of the present invention can realize a minimize, light weighted, resource saving tag-attaching pin unit having a high operation efficiency and which can sufficiently bear for actual working.

On the other hand, the present invention also provide a tag-attaching pin attaching apparatus 20 which can use the above-mentioned tag-attaching pin unit 600 having a new specification, and which can effectively shoot each one of the tag-attaching pin 1 which consists the tag-attaching pin unit 600.

Note that, the object of the present invention is to provide the tag-attaching pin attaching apparatus 20 which can dedicatedly use the eco-friendly tag-attaching pin 1 and which having simple mechanism with less malfunction as well as a maintenance cost of which being small.

And, the further object of the present invention is to provide the tag-attaching pin attaching apparatus 20 which shows an effective pin shooting operation and contributes to the resource saving and low cost performing as well as to the keep-environment movement.

The tag-attaching pin attaching apparatus 20 of the present invention basically has the following technical features.

Note that as a first aspect of the present invention, the tag-attaching pin attaching apparatus 20 basically has the following technical features such that a tag-attaching pin attaching apparatus which can use an unit of tag-attaching pins in which a plurality of the tag-attaching pins, each comprising a fiber section, an inserting head section provided at one end of the fiber section, and a holding section provided at another end of the fiber section, are mutually and parallely arranged with each other, and wherein at least the inserting head sections of each one of the tag-attaching pins which being mutually and adjacently arranged with each other or the holding sections of each one of the tag-attaching pins which being mutually and adjacently arranged with each other, are mutually connected with each other via a connecting member so that the parallel configuration can be maintained, wherein a tag is attached to a desired good with the holding section by inserting the inserting head section of the tag-attaching pin into a hollow needle provided on the tag attaching device and by penetrating the inserting head section through the good with pushing the inserting head section out of the hollow needle, utilizing a predetermined pin pushing means, so as to have the inserting head section attached to a surface of the good with the tag via a part of the good so that the tag is kept by the fiber section, and further wherein the tag-attaching pin attaching apparatus being provided with a hollow needle fixing section which can fixedly hold the hollow needle which is arranged at a front end portion of the attaching device, a shooting pin portion which is positioned opposite to the hollow needle fixing section and can push the inserting head section into the hollow needle, and an insertion head portion shooting out position which being arranged at a position between the hollow needle fixing section and the shooting pin portion, the tag-attaching pin attaching apparatus further comprises a guide plate provided with a first guide section for supplying the unit of tag-attaching pins to the insertion head portion shooting out position and which is integrally fixed or detachably connected to a top surface of the apparatus and further wherein the first guide section of the guide plate comprising a first end portion which is positioned opposite to the insertion head portion shooting out position and a first groove portion which being extended from the first end portion to a rear end portion of the tag-attaching pin attaching apparatus with a predetermined length, having a curved configuration, and further wherein, the first guide section is configured so that the insertion head section and a tag-attaching pin unit pushing member which having a function to push the insertion head section of the tag-attaching pin unit directing to the insertion head portion shooting out position, are slidably inserted therein.

As a second aspect of the present invention, the tag-attaching pin attaching apparatus 20 basically has the technical features such as, a tag-attaching pin attaching apparatus which can use an unit of tag-attaching pins in which a plurality of the tag-attaching pins, each comprising a fiber section, an inserting head section provided at one end of the fiber section, and a holding section provided at another end of the fiber section, are mutually and parallely arranged with each other, and wherein at least the inserting head sections of each one of the tag-attaching pins which being mutually and adjacently arranged with each other or the holding sections of each one of the tag-attaching pins which being mutually and adjacently arranged with each other, are mutually connected with each other via a connecting member so that the parallel configuration can be maintained, wherein a tag is attached to a desired good with the holding section by inserting the inserting head section of the tag-attaching pin into a hollow needle provided on the tag attaching device and by penetrating the inserting head section through the good with pushing the inserting head section out of the hollow needle, utilizing a predetermined pin pushing means, so as to have the inserting head section attached to a surface of the good with the tag via a part of the good so that the tag is kept by the fiber section, and further wherein the tag-attaching pin attaching apparatus being provided with a hollow needle fixing section which can fixedly hold the hollow needle which is arranged at a front end portion of the attaching device, a shooting pin portion which is positioned opposite to the hollow needle fixing section and can push the inserting head section into the hollow needle, and an insertion head portion shooting out position which being arranged at a position between the hollow needle fixing section and the shooting pin portion, the tag-attaching pin attaching apparatus further comprises a guide plate provided with a first guide section for supplying the unit of tag-attaching pins to the insertion head portion shooting out position and which is integrally fixed or detachably connected to a top surface of the apparatus and further wherein the first guide section of the guide plate comprising a first end portion which is positioned opposite to the insertion head portion shooting out position and a first groove portion which being extended from the first end portion to a rear end portion of the tag-attaching pin attaching apparatus with a predetermined length, having a curved configuration, and further wherein, the first guide section is configured so that the insertion head section and a tag-attaching pin unit pushing member which having a function to push the insertion head section of the tag-attaching pin unit directing to the insertion head portion shooting out position, are slidably inserted therein, and further wherein the guide plate is provided with a second guide section having a second groove portion which being arranged in close to and in parallelism with the first guide section and having a curved configuration being identical to or similar to that of the first guide section and further a pushing drive member which can push and move the tag-attaching pin unite pushing member within the second guide section is inserted therein with a sliding manner.

Since the tag-attaching pin attaching apparatus of the present invention has the above-mentioned technical features, it can provide a remarkable tag-attaching pin attaching apparatus in which the tag-attaching pin unit without being provided with a connection bar, i.e, a runner bar, can be moved forward along a curved guide section with utilizing a push driving mechanism which can abut on the most rear end of the tag-attaching pin unit without using the complicated conventional insertion head section feeding mechanism.

Therefore, the tag-attaching pin attaching apparatus which can perform the pin shooting operation effectively even though it having a simple mechanism, and can be produced with a low production costs due to the number of construction elements of the apparatus being small as well as can show less malfunction thereof, can be provided.

At the same time, the present invention can provide the eco-friendly tag-attaching pin attaching apparatus 20 which can suppress a generation of CO2 so that it can contribute to a defense for the global warming.

MODE OF CARRYING OUT THE INVENTION

A configuration of one embodiment of the tag-attaching pin attaching apparatus 20 of the present invention will be explained more precisely, with reference to the drawings, hereunder.

Figure 1:
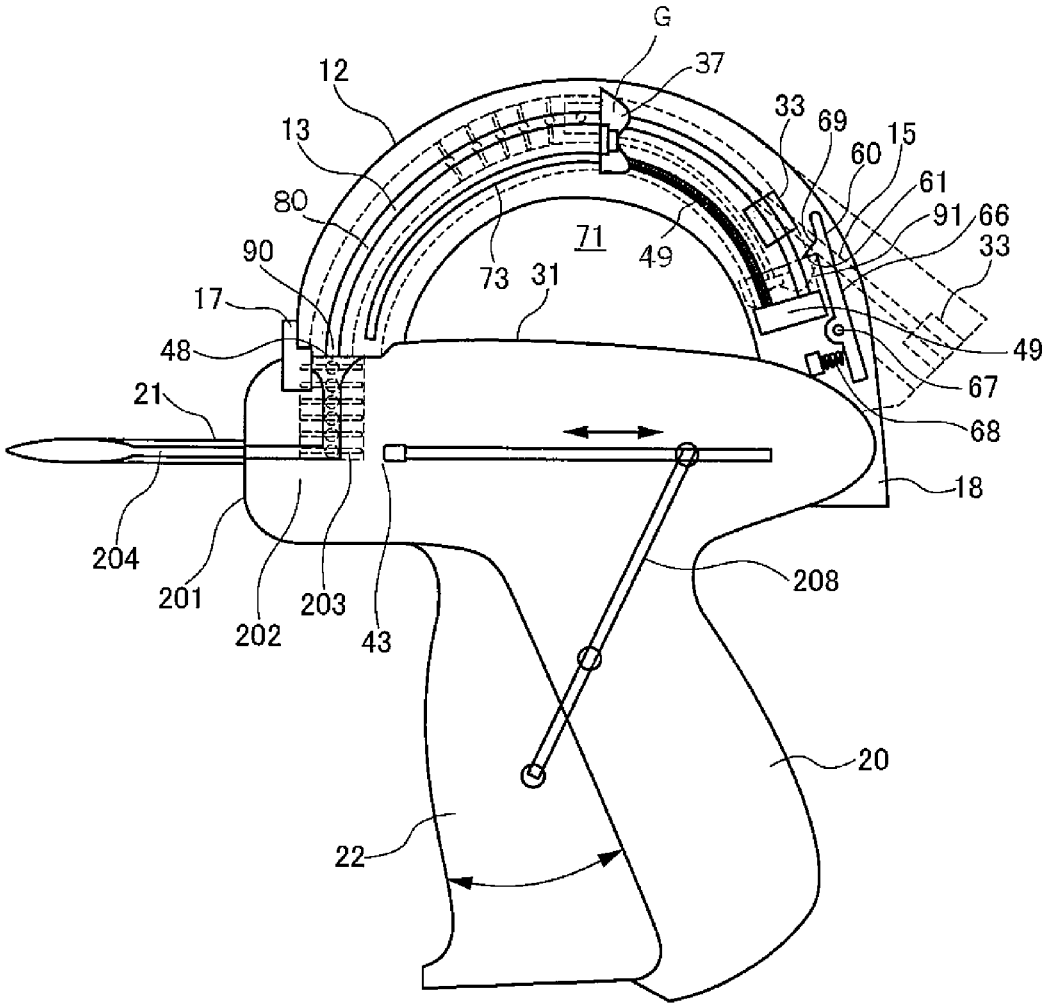
FIG. 1 shows a specific configuration of one embodiment of the tag-attaching pin attaching apparatus of the present invention and illustrates a relationship between the apparatus and the tag-attaching pin unit.
Figure 2:
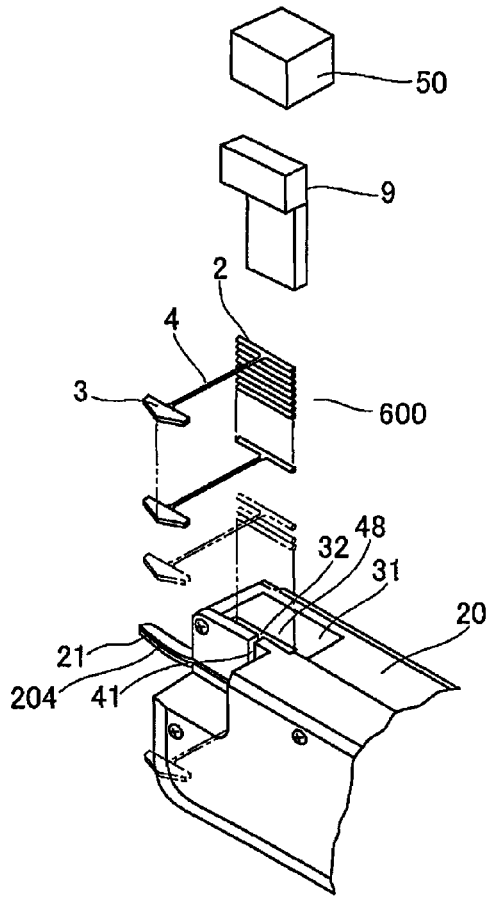
FIG. 2 shows one embodiment of a method of the present invention, how the tag-attaching pin unit as used in the present invention to be inserted into the tag-attaching pin attaching apparatus.
Figure 3:
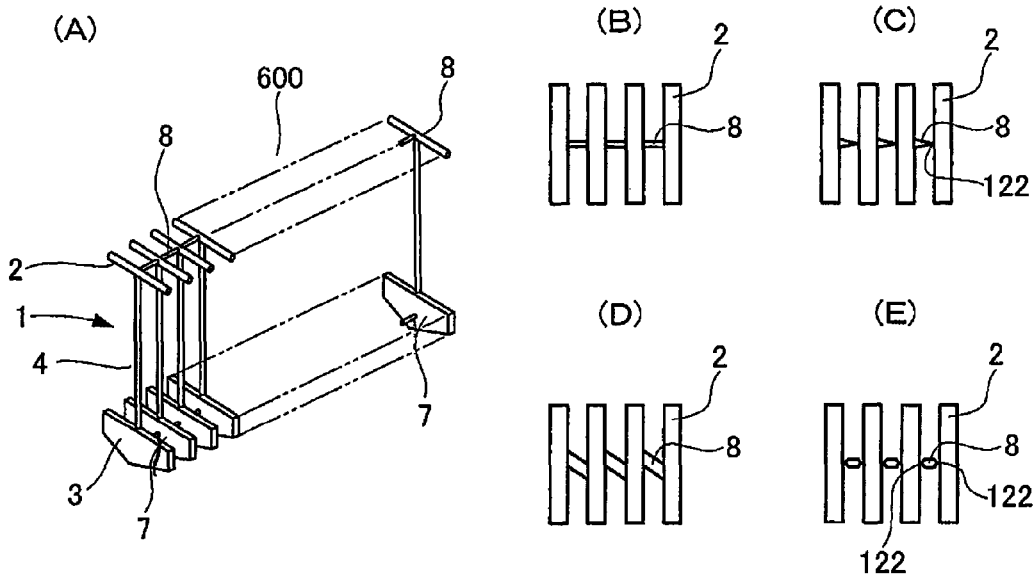
FIG. 3 shows a specific configuration of one embodiment of the tag-attaching pin attaching apparatus.
Figure 4:
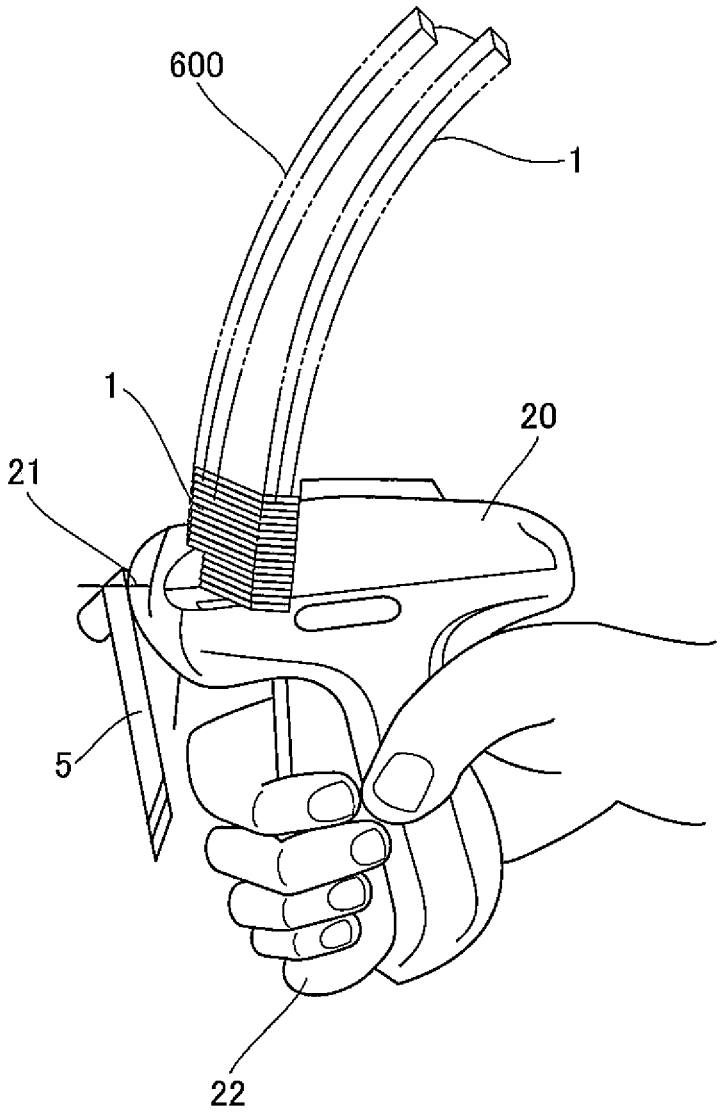
FIG. 4 shows a configuration of the conventional tag-attaching pin attaching apparatus and illustrates an operating condition thereof.
Figure 5:
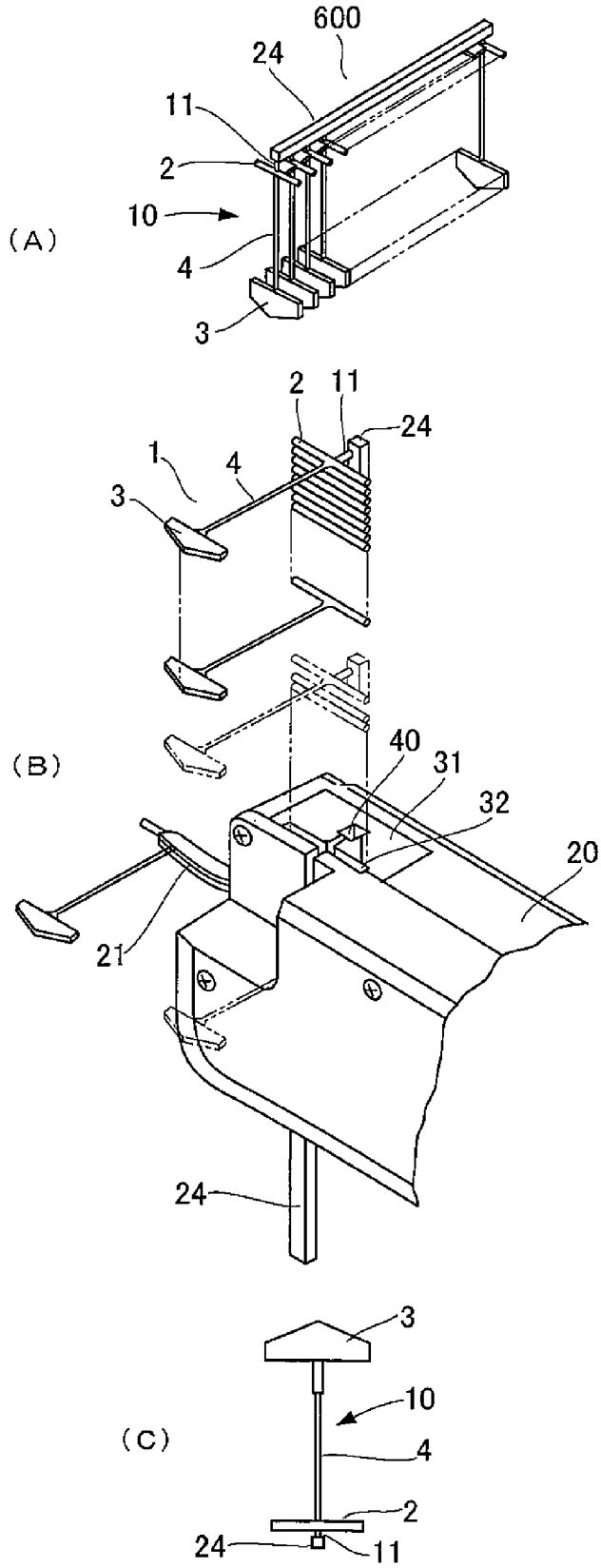
FIG. 5 shows one embodiment of the conventional tag-attaching pin attaching apparatus and is a perspective view of a configuration of the conventional tag-attaching pin unit.
Figure 6:
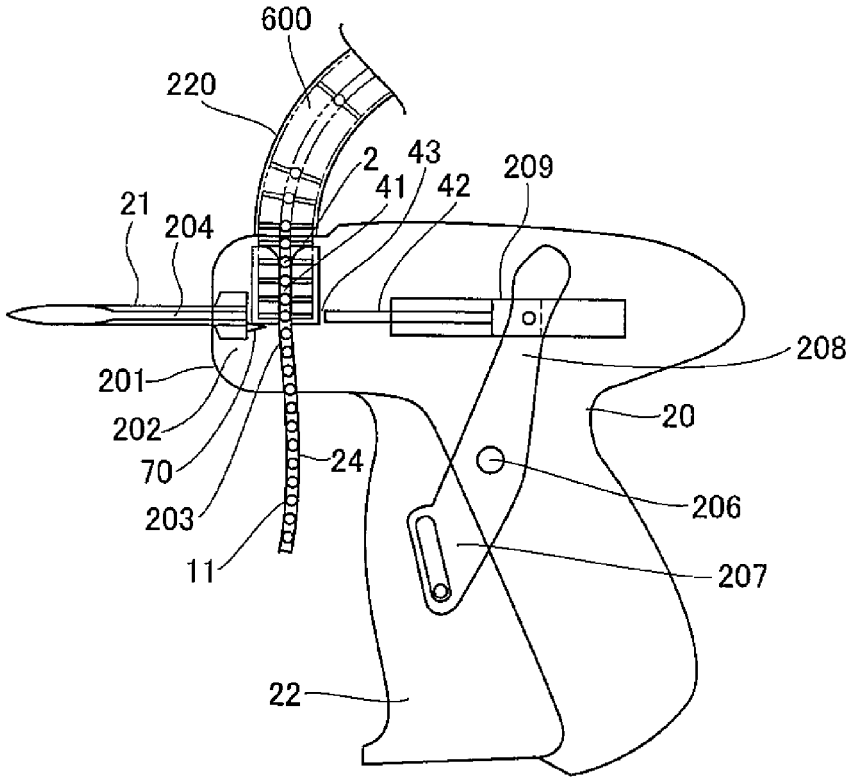
FIG. 6 illustrates one embodiment of an insertion head section shooting operation as performed in the conventional tag-attaching pin attaching apparatus as well as shows a configuration of the conventional tag-attaching pin unit.
Figure 6:
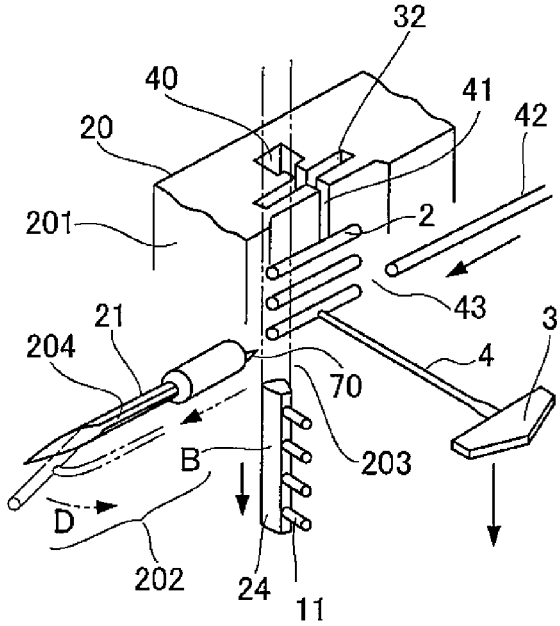
Figure 7:
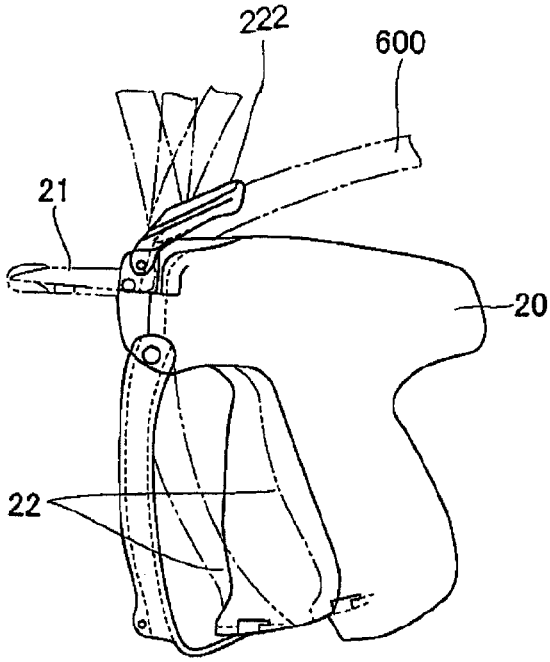
FIG. 7 shows a configuration of a controlling guide means for the tag-attaching pin unit as used for the conventional tag-attaching pin attaching apparatus.
Figure 8:
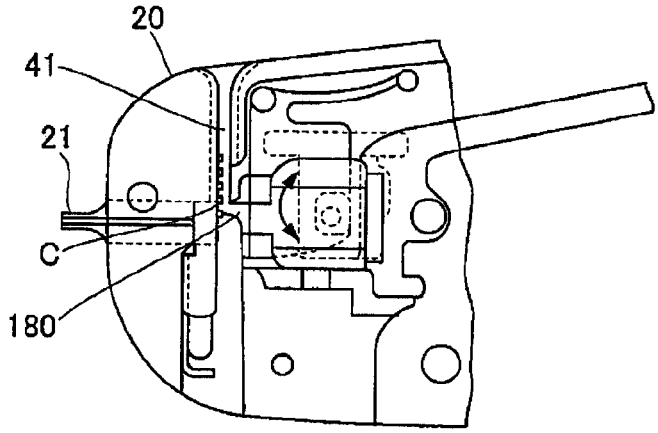
(PRIOR ART) Fig. 8
FIG. 8 shows a side view showing one embodiment of the tag-attaching pin unit feeding mechanism as used for the conventional tag-attaching pin attaching apparatus.
Figure 9:
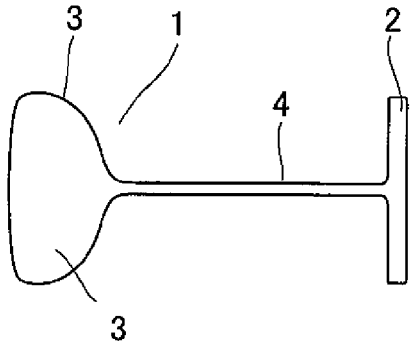
FIG. 9 shows a configuration of the tag-attaching pin as used for the conventional tag-attaching pin attaching apparatus.
Figure 10:
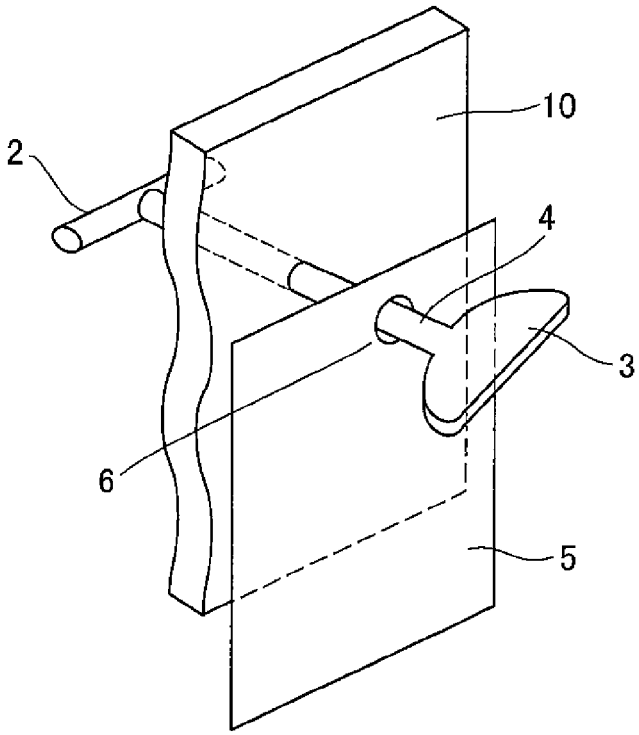
FIG. 10 illustrates an example of how to use the conventional tag-attaching pin.

Note that, FIG. 1 shows a view illustrating the specific configuration of one example of the tag-attaching pin attaching apparatus 20 of the present invention, which uses a sheet like tag-attaching pin unit 600 without being provided with a runner bar 24 and which comprising a plurality of tag-attaching pins, each having a insertion head section 2 and a holding section 3 each of which are connected to either one of the end portions of the fiber section 4, respectively, are adjacently arranged in parallelism with each other, as shown in FIGS. 2 and 3, and further wherein when the tag-attaching pin unit 600 is mounted on the tag-attaching pin attaching apparatus 20, as shows in FIG. 2, the insertion head section 2 of the tag-attaching pin unit 600 is inserted into a vertical groove 32 and simultaneously with this, the fiber section 4 thereof is inserted into a vertical groove 41, first and then the insertion head section 2 is arranged in a position opposite to the one in the vicinity of the hollow needle fixing section and it is pushed out from a hollow needle 21 by a predetermined pin shooting means 42 so that the insertion head section 2 is engaged with a predetermined good thereby a desired labels can be attached to the good with holding the label by the holding section 3 and the fiber section 4.

And more precisely, FIG. 1 discloses a specific configuration of a first embodiment of the tag-attaching pin attaching apparatus 20 of the present invention, in which a tag-attaching pin attaching apparatus 20 uses a tag-attaching pins unit 600 in that a plurality of the tag-attaching pins 1, each comprising a fiber section 4, an inserting head section 2 provided at one end of the fiber section 4, and a holding section 3 provided at another end of the fiber section 4, are mutually and parallely arranged with each other, and wherein at least the inserting head sections 2 of each one of the tag-attaching pins 1 which being mutually and adjacently arranged with each other or the holding sections 3 of each one of the tag-attaching pins 1 which being mutually and adjacently arranged with each other, are mutually connected with each other via a connecting member 7 or 8 so that the parallel configuration thereof can be maintained without using the connection bar 24, and wherein a tag 5 is attached to a desired good 10 with the holding section 3 by inserting the inserting head section 2 of the tag-attaching pin 1 into a hollow needle 21 provided on the tag-attaching pin attaching device and by penetrating the inserting head section 2 through the good 10 with pushing the inserting head section 2 out of the hollow needle 21, utilizing a predetermined pin shooting means 42, so as to have the inserting head section 2 attached to a surface of the good 10 with the tag 5 via a part of the good so that the tag 5 is kept by the fiber section 4, and further wherein the tag-attaching pin attaching apparatus 20 being provided with a hollow needle fixing section 202 which can fixedly hold the hollow needle 21 which is arranged at a front end portion of the tag-attaching pin attaching apparatus 20, a shooting pin portion 43 which is positioned opposite to the hollow needle fixing section 202 and can push the inserting head section 2 into the hollow needle 21, and an insertion head portion shooting out position 203 which being arranged at a position between the hollow needle fixing section 201 and the shooting pin portion 43.

And further wherein the tag-attaching pin attaching apparatus 20 further comprises a guide plate 12 provided with a first guide section 13 for supplying the unit of tag-attaching pins 600 to the insertion head portion shooting out position 203 and which is integrally fixed or detachably connected to a top surface of the apparatus 20 and further wherein the first guide section 13 of the guide plate 12 comprising a first end portion 90 which is positioned opposite to the insertion head portion shooting out position 203 and a first groove portion 81 which being extended from the first end portion 90 to a rear end portion 204 of the tag-attaching pin attaching apparatus 20 with a predetermined length, having a curved configuration, and further wherein, the first guide section 13 is configured so that the insertion head section 2 of the tag-attaching pin unit 600 and a tag-attaching pin unit pushing member 9 which having a function to push the insertion head section 2 of the tag-attaching pin unit 600 directing to the insertion head portion shooting out position 203, are slidably inserted therein.

On the other hand, the tag-attaching pin attaching apparatus 20 of a second embodiment of the present invention, is also disclosed in FIG. 1, in which the tag-attaching pin attaching apparatus 20 of the present invention, which uses a sheet like tag-attaching pin unit 600 without being provided with a runner bar 24 and which comprising a plurality of tag-attaching pins, each having a insertion head section 2 and a holding section 3 each of which are connected to either one of the end portions of the fiber section 4, respectively, are adjacently arranged in parallelism with each other, as shown in FIGS. 2 and 3, and further wherein when the tag-attaching pin unit 600 is mounted on the tag-attaching pin attaching apparatus 20, as shows in FIG. 2, the insertion head section 2 of the tag-attaching pin unit 600 is inserted into a vertical groove 32 and simultaneously with this, the fiber section 4 thereof is inserted into a vertical groove 41, first and then the insertion head section 2 is arranged in a position opposite to the one in the vicinity of the hollow needle fixing section and it is pushed out from a hollow needle 21 by a predetermined pin shooting means 42 so that the insertion head section 2 is engaged with a predetermined good thereby a desired labels can be attached to the good with holding the label by the holding section 3 and the fiber section 4.

And more precisely, FIG. 1 discloses a specific configuration of a first embodiment of the tag-attaching pin attaching apparatus 20 of the present invention, in which a tag-attaching pin attaching apparatus 20 uses a tag-attaching pins unit 600 in that a plurality of the tag-attaching pins 1, each comprising a fiber section 4, an inserting head section 2 provided at one end of the fiber section 4, and a holding section 3 provided at another end of the fiber section 4, are mutually and parallely arranged with each other, and wherein at least the inserting head sections 2 of each one of the tag-attaching pins 1 which being mutually and adjacently arranged with each other or the holding sections 3 of each one of the tag-attaching pins 1 which being mutually and adjacently arranged with each other, are mutually connected with each other via a connecting member 7 or 8 so that the parallel configuration thereof can be maintained without using the connection bar 24, and wherein a tag 5 is attached to a desired good 10 with the holding section 3 by inserting the inserting head section 2 of the tag-attaching pin 1 into a hollow needle 21 provided on the tag-attaching pin attaching device and by penetrating the inserting head section 2 through the good 10 with pushing the inserting head section 2 out of the hollow needle 21, utilizing a predetermined pin shooting means 42, so as to have the inserting head section 2 attached to a surface of the good 10 with the tag 5 via a part of the good so that the tag 5 is kept by the fiber section 4, and further wherein the tag-attaching pin attaching apparatus 20 being provided with a hollow needle fixing section 202 which can fixedly hold the hollow needle 21 which is arranged at a front end portion of the tag-attaching pin attaching apparatus 20, a shooting pin portion 43 which is positioned opposite to the hollow needle fixing section 202 and can push the inserting head section 2 into the hollow needle 21, and an insertion head portion shooting out position 203 which being arranged at a position between the hollow needle fixing section 201 and the shooting pin portion 43.

And further wherein the tag-attaching pin attaching apparatus 20 further comprises a guide plate 12 provided with a first guide section 13 for supplying the unit of tag-attaching pins 600 to the insertion head portion shooting out position 203 and which is integrally fixed or detachably connected to a top surface of the apparatus 20 and further wherein the first guide section 13 of the guide plate 12 comprising a first end portion 90 which is positioned opposite to the insertion head portion shooting out position 203 and a first groove portion 81 which being extended from the first end portion 90 to a rear end portion 204 of the tag-attaching pin attaching apparatus 20 with a predetermined length, having a curved configuration, and further wherein, the first guide section 13 is configured so that the insertion head section 2 of the tag-attaching pin unit 600 and a tag-attaching pin unit pushing member 9 which having a function to push the insertion head section 2 of the tag-attaching pin unit 600 directing to the insertion head portion shooting out position 203, are slidably inserted therein, and further wherein, the guide plate 12 is provided with a second guide section 73 having a second groove portion 83 which being arranged in close to and in parallelism with the first guide section 81 and having a curved configuration being identical to or similar to that of the first guide section 81 and further a pushing drive member 49 which can push and move the tag-attaching pin unite pushing member 9 within the second guide section 73 is slidably inserted therein.

As explained above, the present invention has been developed with an object, such as, how effectively and how surely an operator can attach the tag-attaching pin of the tag-attaching pin unit without a runner bar, to a desired good with utilizing the tag-attaching pin attaching apparatus 20 without any operational trouble, in comparing with the conventional tag-attaching pin attaching apparatus 20.

Accordingly, the tag-attaching pin attaching apparatus 20 of the present invention may be provided with a conventional pin shooting mechanism as well as may be provided with the mechanism which is shown in the present invention.

Note that, in the tag-attaching pin attaching apparatus 20 of the present invention, the guide plate 12 which includes the guide section 13 guiding the tag-attaching pin unit 600, can be detachably mounted on the upper surface of the main body of the tag-attaching pin attaching apparatus 20 or it can be integrally fixed on the tag-attaching pin attaching apparatus 20.

Further, the guide plate 12 and the tag-attaching pin attaching apparatus 20 can also directly be formed integrally by a molding process.

And, The guide plate 12 of the present invention is provided with a first guide section 13 serving to feed the tag-attaching pin unit 600 to the insertion head portion shooting out position 203, whereby the tag-attaching pin unit 600 can be inserted thereinto, slidably, while the tag-attaching pin unit pushing member 9 which is also slidably inserted into the first guide section 13, is abutted to one end portion of the insertion head section 2 which is opposite to another end portion thereof which is facing to the insertion head portion shooting out position 203 of the tag-attaching pin attaching apparatus 20.

And further wherein, by applying a suitable bias force to the tag-attaching pin unit pushing member 9 utilizing a suitable diving mechanism, the tag-attaching pin unit pushing member 9 can always push the tag-attaching pin unit 600 in a direction to the insertion head section shooting out position 203 is always and thereby it becomes possible for the tag-attaching pin attaching apparatus 20 to feed the respective tag-attaching pin which consists the tag-attaching pin unit 600, completely to the insertion head portion shooting out position 203, one by one, without using the complicated conventional tag-attaching pin feeding mechanism.

Further, in the present invention, to make it possible that a tag-attaching pin unit 600 having a long longitudinal length can be used, as well as it is necessary to restrict a height of the guide plate 12, it is preferable that the first guide section 13 is configured to have a curved line.

By adopting the above-mentioned guide section 13, it is possible to make use of the tag-attaching pin unit 600 having a relatively long longitudinal length as well as it also becomes possible that an operation for the tag-attaching pin unit 600 to be pushed and moved forward to the insertion head section shooting out position 203, is surely and stably performed by sliding inside the guide section 13 with receiving the predetermined bias force.

Note that in the present invention, the first guide section 13 comprises a first groove portion 81 having a cross-sectional configuration with a predetermined width and predetermined depth so as to enable the insertion head portion 2 of the tag-attaching pin 1 and the tag-attaching pin unit pushing member 9 to move and slide jointly along the groove portion 81.

And a first slit portion 44 is provided on around a center portion of the first groove portion 81 through which and along which the fiber section 4 of the tag-attaching pin 1 can penetrate and move slidably.

The first guide section 13 provided in the guide plate 12 of the present invention, has a first terminal end portion 90 provided at one end portion thereof which is directing to the insertion head portion shooting out position 203 of the tag-attaching pin attaching apparatus 20, while a second terminal is provided at an end portion thereof opposite to the first terminal portion 90 and which is directing to a position in the vicinity of a rear end of the tag-attaching pin attaching apparatus 20.

Although the first terminal end portion is opened in order for each one of the tag-attaching pin 1 to be slid in the guide section 13 and output therefrom to the insertion head portion shooting out position 203, the second terminal end portion 91 is preferably closed.

On the other hand, in order to insert the tag-attaching pin unit 600 into the first guide section 13, it can be provided an opening portion 33 through which the insertion head portion of the tag attaching pin 1 can be slidably inserted into the first guide section 13, at a position which is a part of the first guide section 13 and in the vicinity of the second terminal end portion 91 of the first guide section 13 and further including an area in which the first slit portion 44 is located.

At an area beneath the opening 33, it is one preferable embodiment of the present invention that a suitable tapered surface member S is provided in order for the insertion head portion 2 of the tag-attaching pin unit 600 to be smoothly inserted slidably into the first groove portion 81 from external portion thereof.

On the other hand, as a separate embodiment, a third guide section 15 which being branched off from an optional position in the vicinity of the second terminal end portion 91 of the first groove portion 81 in the first guide section 81, is provided and further the third guide section 15 is connected to a suitable opening 33 which is formed on an outer peripheral edge portion of the guide plate 12 so that the tag-attaching pin unit 600 can be guided and inserted into the first groove portion 81 of the first guide section 13 via the third guide section 15.

In the present invention, the tag-attaching pin unit pushing member 9 is previously inserted into the first groove portion 81 of the first guide section 13 and it is applied with a desired bias force by an pushing drive mechanism 49 for the tag-attaching pin unit pushing member 9, which is provided at a position in the vicinity of the second terminal end portion 91 of the first guide section 13, so that the tag-attaching pin unit pushing member 9 is always forced to be moved slidably therein so as to be directed to the first terminal end portion of the first guide section 13.

And further, the tag-attaching pin unit pushing member 9 is configured so that it is moved in sliding manner inside the first groove portion 81 directing from the second terminal end portion 91 to the first terminal end portion 90.

Note that, the tag-attaching pin unit pushing member 9 is configured so that it is enabled to compulsory be slid with a suitable operation member 37 which is extended outwardly from the first guide section 13 via the first slit portion 44 operated by an operator.

And further, before it is operated, the operator can return the tag-attaching pin unit pushing member 9 back to the second terminal end portion 91 by using the operation member 37 and at this returned position, the operation member 37 is engaged with a hook member of a suitable stopper portion 60 so that the tag-attaching pin unit pushing member 9 is fixedly maintained as it is.

Mean while, after the tag-attaching pin unit 600 having a predetermined length is inserted into the guide section 13 via the opening 33 and arranged in front of the tag-attaching pin unit pushing member 9 in the guide section 13, by releasing the stopper so as to give a bias force to the tag-attaching pin unit pushing member 9 by the pushing drive mechanism 49, the tag-attaching pin unit 600 as arranged in the first guide section 13, is pushed to be moved and slid so that a front edge portion of the tag-attaching pin unit 600 is moved to the insertion head portion shooting out position 203 of the tag-attaching pin attaching apparatus 20.

After that at every time when the operation lever 22 of the tag-attaching pin attaching apparatus 20 is operated, each one of the tag-attaching pins of the tag-attaching pin unit 600 is in turn descended one by one to the insertion head portion shooting out position 203 so that each one of the tag-attaching pins is surely shot out, respectively, by the shooting pin portion 43 via the hollow needle 21.

On the other hand, in a separate embodiment of the tag-attaching pin attaching apparatus of the present invention, when a spring member is used as the pushing drive mechanism 49 for driving the tag-attaching pin unit pushing member 9, the spring member 49 is slid inside a second guide section 73 formed in the guide plate 12 and arranged in parallelism with the first guide section 13.

As the tag-attaching pin attaching apparatus 20 of the present invention, a conventional well-known tag-attaching pin attaching apparatus may be used but in a case may be, it is preferred that a portion of the tag-attaching pin attaching apparatus 20 and the guide plate 12 are integrally molded into one body.

Figure 11:
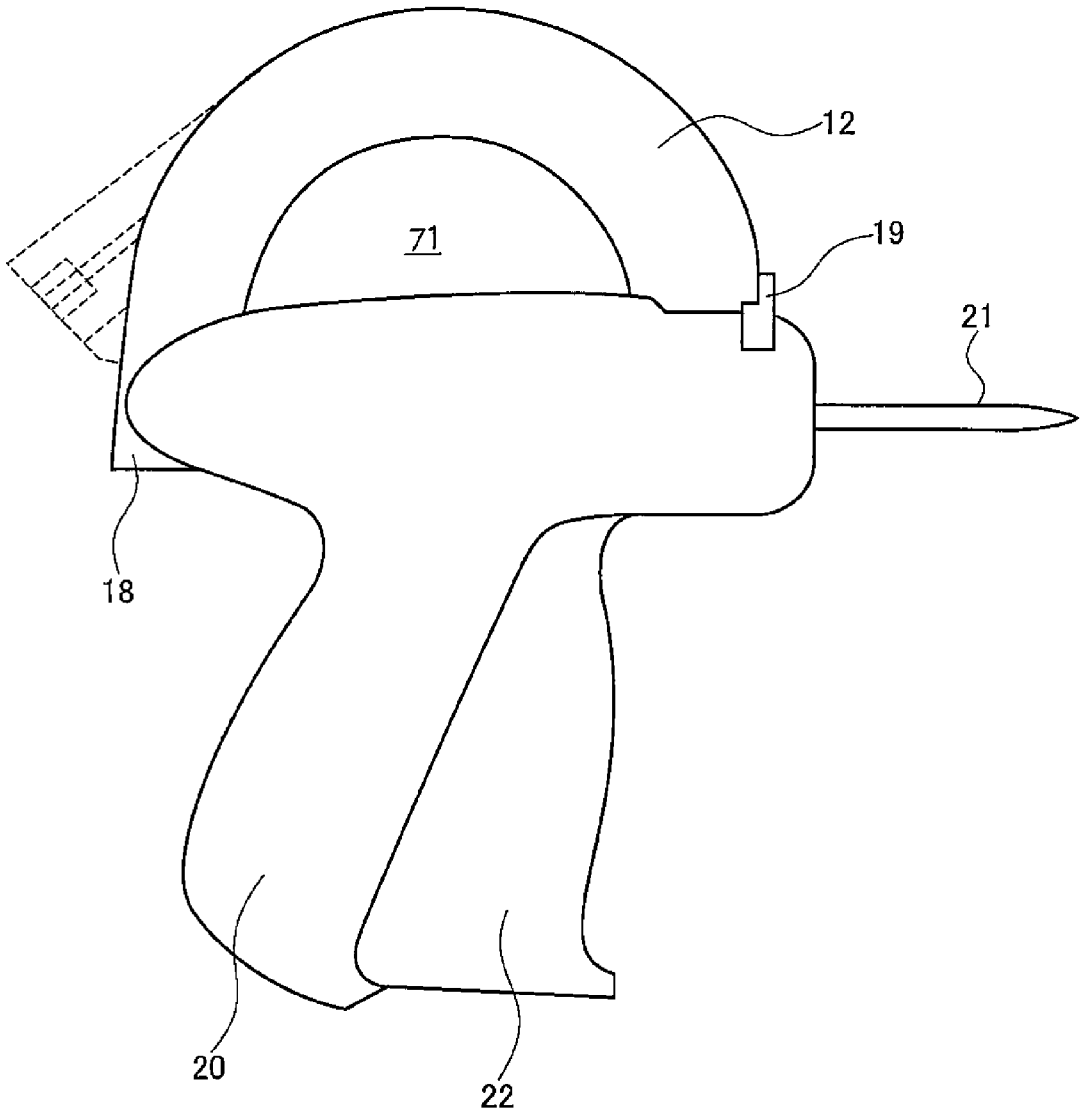
FIG. 11 shows a back side view of the tag-attaching pin attaching apparatus of the present invention as shown in FIG. 1.
Figure 12:
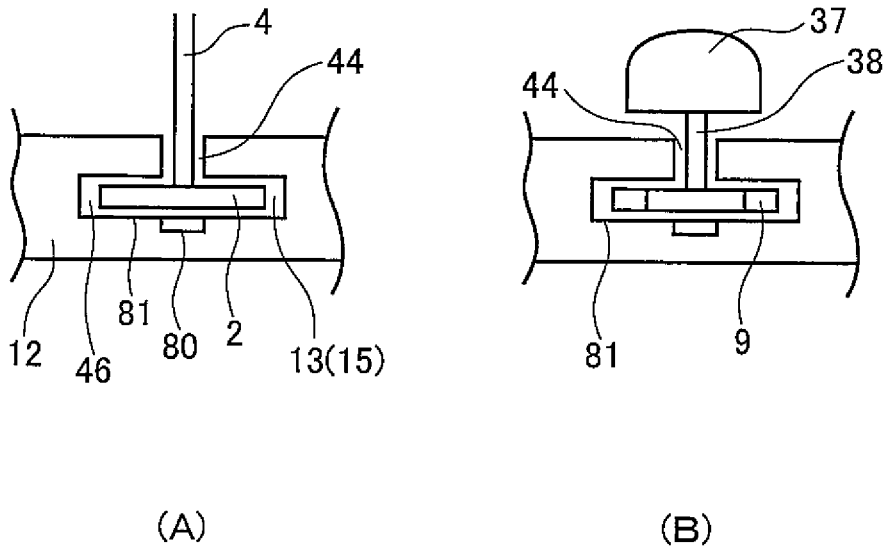
FIG. 12 shows one embodiment of a configuration of a guide section which is provided in the guide plate of the present invention.

Further, in the tag-attaching pin attaching apparatus 20 of the present invention, the tag-attaching pin attaching apparatus 20 and the guide plate 12 are separately molded with each other, and as shown in FIGS. 1 and 11, the guide plate 12 may be detachably coupled to an upper surface portion 31 of the tag-attaching pin attaching apparatus 20 via a detachable coupling members 17, 18 and 19.

FIG. 11 shows a back side view of FIG. 1.

The guide plate 12 as used in the present invention, is preferably made of a suitable plastic resin and the overall configuration thereof is not specifically restricted, but it is possible to set the dimension thereof at a suitable one depending upon the length of the tag-attaching pin unit 600.

However, since there must be some disadvantages of the working efficiency thereof being deteriorated when the guide plate 12 having a height which being too high, is mounted on an upper space 31 of the tag-attaching pin attaching apparatus 20, it is desirable that the first guide section 13 introduces a curved configuration into a part thereof.

On the other hand, as shown in FIG. 13(A), the first guide section 13 is provided with a first groove portion 81 formed with a sliding passage way 46 having a rectangular cross-sectional area being slightly larger than that of a side view of the insertion head portion 2, so that at least the insertion head portion 2 of the tag-attaching pin 1 can be moved in a sliding manner in the inside of the guide plate 12.

In addition to thereabove, between the first groove portion 81 which serving as the sliding passage way 46 and an upper surface of the guide plate 12, a slit portion 44 through which the fiber portion 4 of the tag-attaching pin 1 can be slid, is provided.

On a central portion of the bottom surface of the first groove portion 81, it is preferable that a concaved portion 80 having a suitable depth is formed.

For example, since a portion of the inserting head section 2 of the respective tag-attaching pin 2 of the tag-attaching pin unit 600, especially a portion facing to the bottom surface of the first groove portion 81, is frequently provided with the projection, the fluffs, or the scarred portions, there would exist a lots of opportunities for the tag-attaching pin unit 600 to be prevented from being smoothly moved and slid within the first groove portion 81.

Therefore, to provide such concaved portion 80 in the first groove portion 81 is an effective means to resolve this problem.

The first guide section 13, as mentioned above, is configured so that it allows the tag-attaching pin unite pushing member 9 and a part of the pushing drive mechanism 49 which driving the tag-attaching pin unite pushing member 9 to be moved and slid along therein with the tag-attaching pin unit 600 and thus the relationship between the first guide section 13 and the tag-attaching pin unite pushing member 9 will be explained with reference to FIG. 13(B), hereunder.

Note that, as shown in FIG. 13(B), in an inner portion of the guide plate 12, the first groove portion 81 having a sliding passage 46 which has a rectangular cross-sectional view the area of which being slightly larger than that of the tag-attaching pin unite pushing member 9 so that at least the tag-attaching pin unite pushing member 9 can be slid therein, is provided.

And further, on a portion between the first groove portion 81 and the surface of the guide plate 12, a slit portion 44 through which a connecting rod member 38 having a suitable configuration and connected to an operating portion 37 which can be operated by an operator so that the tag-attaching pin unite pushing member 9 is operated outer surface of the guide plate 12, can be moved and slid, is provided.

Note that, the first groove portion 81 of the first guide section 13 commonly has a specification under which both of the tag-attaching pin unit 600 and the tag-attaching pin unite pushing member 9 are easily moved and slid therethrough.

On the other hand, in the present invention, in the vicinity of the second terminal end portion 91 of the first guide section 13, there is provided with a suitable pushing drive mechanism 49 which can always give a pushing force, i.e., a bias force to the tag-attaching pin unite pushing member 9 so as to push the same directing to the insertion head portion shooting out position 203.

A configuration of the pushing drive mechanism 49 which generates the bias force to be applied to the tag-attaching pin unite pushing member 9, is not specifically restricted to a specific one though, it is preferably consisted with, for example, a coil spring, a spiral spring, an elastic resilient material, or a mechanical mechanism utilizing a fluid flow, an electric energy or a magnetic energy or the like.

The bias force generated by the pushing drive mechanism 49 is configured so as to be directly or indirectly applied to at least a part of the tag-attaching pin unite pushing member 9.

On the other hand, at a position in the vicinity of the second terminal end portion 91 of the first guide section 13, a suitable stopper member 60 which can fixedly hold the tag-attaching pin unite pushing member 9 at a place in the vicinity of the second terminal end portion 91 of the first guide section 13, against the bias force of the pushing drive mechanism 49, is provided.

Although a configuration of the stopper member 60 is not restricted to a specific one, as shown in FIG. 1, it can be configured in that a hook member 61 which can be engaged with a part of the operating member 37 connected to the tag-attaching pin unite pushing member 9, is provided on one end portion of a main body 66 of the stopper member 60 which is rotatably supported on the guide plate 12 via a suitable pivot axis 67, while an opposite end portion of the main body 66 is engaged with a resilient mechanism 68 comprising a suitable spring member or the like so that the hook member 61 of the stopper member 60 is always contacted with a part of the operation member 37 so as to make the stopper function to be effective, and further the stopper function becomes ineffective by pushing the opposite end portion of the main body portion 66 down, causing the hook member 61 to be detached from the operation member 37.

Further, in a case when the operation member 37 is engaged with the stopper member 60, the engagement operation can be performed by the operation member 37 which is connected to the tag-attaching pin unite pushing member 9, being moved by an operator' manual operation so as to push a tapered surface 69 of the stopper member 60 down wardly, thereby the operation member 37 and the hook member 61 of the stopper member 60 are kept in the engaged condition.

Further, in a separate embodiment of the present invention as shown hereunder, the stopper member 60 can also be provided on a part of a tracking lever which is driven in combination with a movement of an operation lever 22.

On the other hand, in the first guide section 13 as used in the present invention, the one of the terminal end portions thereof, that is the first terminal end portion 90 is provided on a position directly facing to an opening end portion 48 for inserting the tag-attaching pin unit 600, and provided on an upper surface portion 31 of the tag-attaching pin attaching apparatus 20 and while the opposite terminal end portion, that is the second terminal end portion 91 is directed to a rear end portion of the tag-attaching pin attaching apparatus 20.

When the tag-attaching pin attaching apparatus 20 of the present invention is actually operated, as shown in FIG. 1, in an initial stage, no such a tag-attaching pin unit 600 is not inserted into the first guide section 13, while the previously inserted tag-attaching pin unite pushing member 9 is fixedly engaged with a suitable stopper member 60 at a position in the vicinity of the second terminal end portion 91 of the first guide section 13.

Under this situation, an operator inserts the suitable tag-attaching pin unit 600 into the first guide section 13 with a manual operation via the opening 33 so that each one of the inserting head section 2 of the tag-attaching pin 1 can be inserted into the first groove portion 81 of the first guide section 13, and still under the manual operation by the operator, the tag-attaching pin unit 600 is moved and slid within the first groove portion 81 of the first guide section 13 by the operator gripping with his hand the holding sections 3 of the tag-attaching pins 1 which are projected from the slit portion 44 of the first guide section 13 and moving them along the first groove portion 81.

By doing this, in the first groove portion 81 of the first guide section 13, the inserting head section 2 of the tag-attaching pin 1 which is located at the most rear end portion of the tag-attaching pin unit 600 which is already inserted into the first groove portion 81, is arranged at a position just in front of the tag-attaching pin unite pushing member 9.

Next, the operator operates the stopper member 60 so as to release the engagement formed between the operation member 37 of the tag-attaching pin unite pushing member 9 and the stopper member 60, thereby a tip end portion of the tag-attaching pin unite pushing member 9 is abutted to the inserting head section 2 of the tag-attaching pin 1 which is located at the most rear end portion of the tag-attaching pin unit 600, and the tag-attaching pin unite pushing member 9 is continuously pushing over all the tag-attaching pin unit 600 and finally it always pushes the tag-attaching pin unit 600 to the insertion head portion shooting out position 203 via the first terminal end portion 90 which is serving as an opening of the first guide section 13.

As the result thereof, in the present invention, it becomes possible that each one of the respective tag-attaching pin 1 forming the tag-attaching pin unit 600 is correctly arranged in turn on the insertion head portion shooting out position 203, one by one and can be received the predetermined shooting operation only by operating the operation lever 22 of the tag-attaching pin attaching apparatus 20 without utilizing the conventional tag-attaching pin 1 feeding mechanism.

Figure 15:
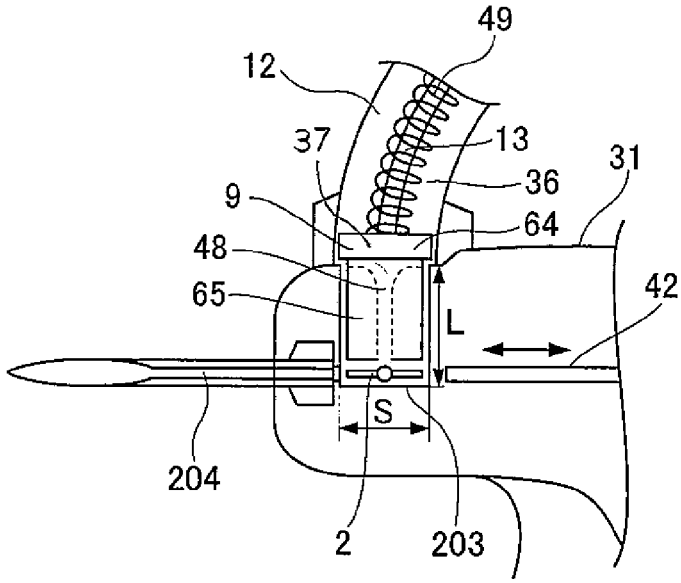
FIG. 15 illustrates a relationship between the tag-attaching pin unit pushing member and an insertion head portion shooting out position both of which are used for the tag-attaching pin attaching apparatus of the present invention.
Figure 16:
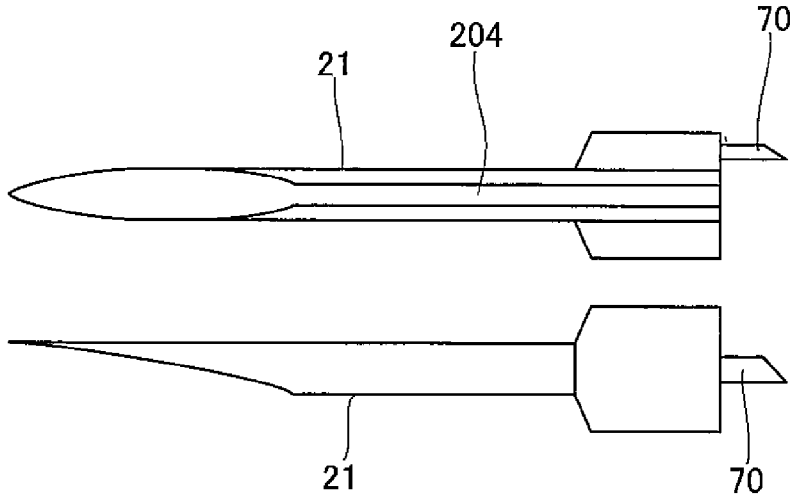
FIG. 16 shows one embodiment of a configuration of a hollow needle which can be used in the tag-attaching pin attaching apparatus of the present invention.

And further, after all of the tag-attaching pin 1 consisting the tag-attaching pin unit 600 have been shot out, as shown in FIG. 15, the operator returns the operation member 37 connected to the tag-attaching pin unite pushing member 9 and which is located at a position in the vicinity of the opening end portion 48 of the tag-attaching pin attaching apparatus 20 manually back to the second terminal end portion 91 of the first guide section 13 so that the tag-attaching pin unite pushing member 9 is engaged with the stopper member 60 so as to be fixedly held at this position as shown in FIG. 1.

The guide plate 12 of the present invention, may be made by a material without having any bore, cavity or opening therein but in order to reduce an amount of consumption of the law materials as well as to reduce a weight of the apparatus, as shown in FIG. 1, the guide plate 12 is preferably provided with an opening window 71.

Figure 14:
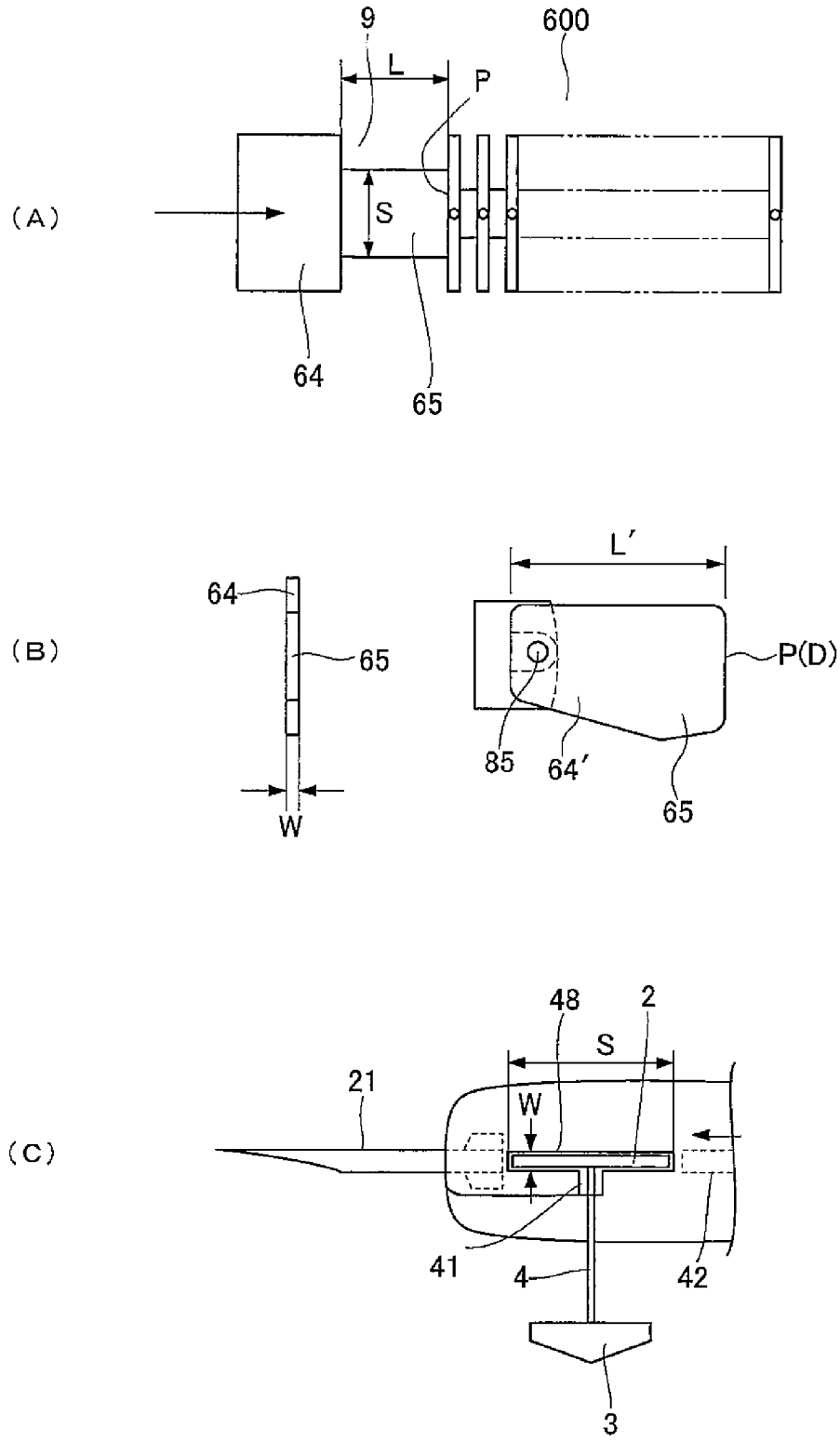
FIG. 14 shows one example of a configuration of the tag-attaching pin unit pushing member which is used for the tag-attaching pin attaching apparatus of the present invention.

Note that FIG. 14 (FIG. 15) shows a specific embodiment of the tag-attaching pin unite pushing member 9.

And further, as a pushing force transmitting means of the pushing drive mechanism 49 to the tag-attaching pin unite pushing member 9, the means is preferably configured so that the bias force of the pushing drive mechanism 49 should be applied to a part of either one of the tag-attaching pin unite pushing member 9 or the operation member 37.

Figure 13:
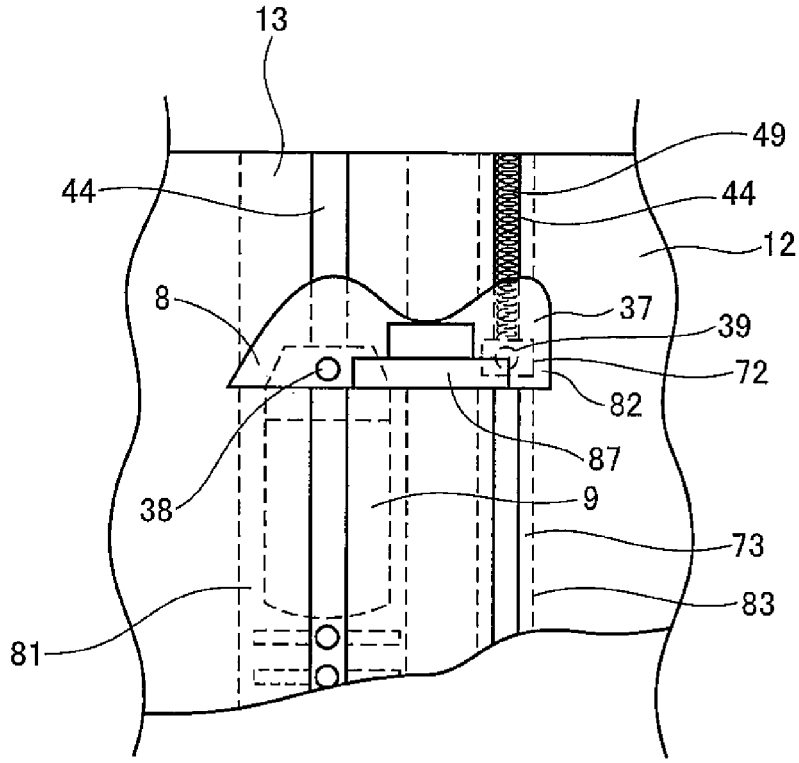
FIG. 13 shows precise configuration of a guide section and an operation member as used in the present invention.
Figure 13:
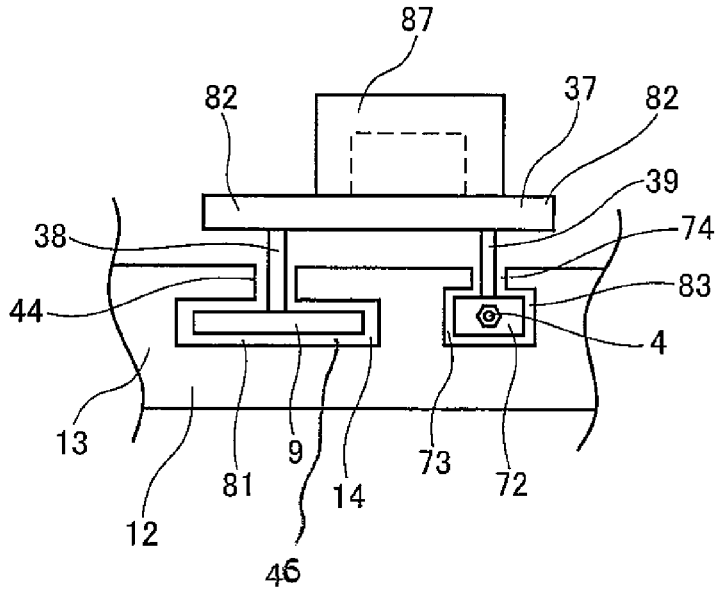

However, the specific configuration thereof should not be restricted to a specific configuration, but, for example, it can be configured so that the bias force can be directly to the operation member 37, or as shown in FIG. 13, it can be configured so that the bias force can be applied to a bias force receiving member 72 which is extended from the operation member 37.

In the embodiment of the present invention as shown in FIG. 13, a suitable connecting member 39 is provided at a portion which is different from the portion at which the connecting member 38 connected to the tag-attaching pin unite pushing member 9 of the operation member 37 is provided, and a suitable bias force receiving member 72 is provided on the connecting member 39.

Further, in a specific embodiment, the bias force receiving member 72 is configured so that it can be moved and slid within a second guide section 73 which is separately provided from the first guide section 13, when the tag-attaching pin unite pushing member 9 is moved and slid within the first guide section 13 and thus the bias force receiving member 72 can push and drive the operation member 37 and simultaneously with this it can also control the moving locus of the operation member 37.

This means that in the separate embodiment of the present invention, the guide plate 12 is provided with the second guide section 73 which being arranged in parallelism with the first guide section 13, and in the second guide section 73, the bias force receiving member 72 which serving as an operation member sliding and moving portion which is connected to the operation member 37 via a suitable connecting member 39, is slidably inserted and further, the bias force receiving member 72 is configured so as to always receive the bias force directing to the insertion head portion shooting out position 203.

The connecting member 39 is projected from the second guide section 73 via the second slit portion 74 so as to be exposed on an outer surface of the guide plate 12.

In the case in which the pushing drive mechanism 49 which can generate the bias force comprises a spring member, the bias force receiving member 72 is configured so that it can receive the bias force generated by a spring member 49, for example, a spiral spring 49, which being provided between the bias force receiving member 72 and the second terminal end portion 91 which locates at a position opposite to the insertion head portion shooting out position 203 formed in the first guide section 13, within the second groove portion 83 formed inside the second guide section 73.

The configuration of each one of the first and the second guide sections 13 and 73 is not restricted to a specific one, though, it is preferable that a configuration of at least a part of at least a part of the guide portions may show a linear configuration or may show a curved configuration.

A distance formed between the first guide section 13 and the second guide section 73 is preferably set at a distance formed between the connecting members 38 and 39.

Hereunder, a specific configuration of one embodiment of the operation member 37 is explained.

As shown in FIG. 13, the operation member 37 comprises a substrate portion 82 and a gripping member 87 and on a back surface of the substrate portion 82, the tag-attaching pin unite pushing member 9 which is moved and slid within the first guide section 13, is connected via the connecting member 38, on the other hand, the connecting member 39 is arranged at a position with a predetermined length apart of the connecting member 38.

And at a lower end portion of the connecting member 39, the bias force receiving member 72 which serving as an operation member sliding and moving portion which can be moved and slid within the second groove portion 83 of the second guide section 73, is provided.

A configuration or size of the gripping member 87 as used in the present invention are not restricted to a specific ones though, a suitable configuration and a suitable size thereof can be selected as long as they do not disturb the operation efficiency of the tag-attaching pin attaching apparatus.

And further, the bias force receiving member 72 always receives the bias force which is directing to the opening end portion 48 of the tag-attaching pin attaching apparatus 20 by a spiral spring 49 which is one of the pushing drive mechanism 49 enabling to apply a bias force to the bias force receiving member 72, which is arranged in the second groove portion 83 of the second guide section 73 and arranged between the second terminal end portion 91 in the second groove portion 81 of the second guide section 73 and the bias force receiving member 72.

As the result of this configuration, the tag-attaching pin unite pushing member 9 which is integrally connected to the bias force receiving member 72 via the operation member 37, is moved and slid forward directing to the first terminal end portion 90 within the first guide section 13, and then it is abutted to the inserting head section 2 of the tag-attaching pin 1 which is located at the most rear end portion of the tag-attaching pin unit 600, which is already inserted into the first guide section 13 so that the overall tag-attaching pin unit 600 can be always pushed in the direction of the opening end portion 48 of the tag-attaching pin attaching apparatus 20

Accordingly, after when the pin shooting means 42 has shot out the inserting head section 2 of the tag-attaching pin 1 which is located at the most front end portion of the tag-attaching pin unit 600, which is located at the insertion head portion shooting out position 203 and then it has returned to its original position, the next inserting head section 2 of the tag-attaching pin 1 to be shot out in the next operation, can be surely descended to the insertion head portion shooting out position 203 so as to make it possible for the tag-attaching pin 1 to be ready to the next pin shooting operation.

Next, a specific configuration of the tag-attaching pin unite pushing member 9 which is used in the present invention, is explained more detailed, hereunder.

The tag-attaching pin unite pushing member 9 of the present invention, as shown in FIGS. 14(A) to 14(C), comprises at least a main body portion 64 and a front end portion 65 which can abut to the inserting head section 2 of the tag-attaching pin 1 which is located at the most rear end portion of the tag-attaching pin unit 600, and the front end portion 65 preferably has a rectangular cross-sectional configuration with a width W of being identical to or shorter than a diameter of the inserting head section 2 and with a length S of being identical to or shorter than a length of the inserting head section 2.

Further, as shown in FIG. 15, the front end portion 65 of the tag-attaching pin unite pushing member 9 has preferably a configuration in which the front end portion 65 is extended forwardly by a length corresponding to the length L representing the length formed between the opening end portion 48 for inserting the inserting head section 2 and provided on the upper surface 31 of the tag-attaching pin attaching apparatus 20 and the insertion head portion shooting out position 203.

Note that, in the present invention, it is necessary that all of the inserting head sections 2 of the tag-attaching pins 1, even including the last tag-attaching pin 1, of the tag-attaching pin unit 600, should be surely descended to the insertion head portion shooting out position 203, respectively, and being arranged on this position.

On the other hand, since the tag-attaching pin unite pushing member 9 is attached to the main body portion 64 and the main body portion 64 usually has a cross-sectional configuration being larger than that of the tag-attaching pin unite pushing member 9, the main body portion 64 cannot be inserted into the opening end portion 48 for inserting the inserting head section 2 having a width and a length being larger than those of the inserting head section 2 of the tag-attaching pin 1.

Therefore, the tag-attaching pin unite pushing member 9 preferably has a configuration in that the front end portion 65 of the main body portion 64 can be inserted into the opening end portion 48 for inserting the inserting head section 2, thereby the most tip end portion P of the front end portion 65 of the tag-attaching pin unite pushing member 9 can surely push out the inserting head section 2 of the last tag-attaching pin 1 consisting the tag-attaching pin unit 600, to the insertion head portion shooting out position 203.

And, the configuration of the main body portion 64 of the tag-attaching pin unite pushing member 9 of the present invention, is not restricted to a specific configuration, but it is prefer that the front end portion 65 is configured so that it can be moved and slid forward along the first groove portion 81 of the first guide section 13 by a suitable pushing drive mechanism 49 as well as it can be easily moved back to a position in the vicinity of the second terminal end portion 91 of the first guide section 13 when the pin shooting operation has been completed.

In a different embodiment of the present invention, as shown in FIG. 14(D), with regard to the configuration of the tag-attaching pin unite pushing member 9, it is not necessary that the tag-attaching pin unite pushing member 9 comprises the main body portion 64 and the front end portion 65, instead, it can comprises the main body portion 64 and the front end portion 65 each being integrally connected with each other.

In this example, the main body portion 64 has a suitable configuration and it can be used in the present invention when the maximum thickness or width as well as length thereof are set at the values being fallen within the specification of the front end portion 65 as shown in FIG. 14(A).

On the other hand, in this embodiment, it is also preferable that the main body portion 64 and the front end portion 65 of the tag-attaching pin unite pushing member 9 are pivotally connected with each other with reference to a suitable pivoting axis.

In the tag-attaching pin attaching apparatus 20 of the present invention, a cutter portion is basically not necessary but if it would be required, it is prefer that a suitable cutter portion 70 is provided at a rear end portion of the hollow needle 21 so as to cut the second connecting member 8 which is provided between the inserting head sections 2 being adjacently arranged with each other at every time when the inserting head sections 2 is shot out.

Regarding the position of the cutter portion 70 which is provided on the hollow needle 21, it is necessary for the cutter portion 70 to be arranged at a position in the hollow needle 21 being different from the position at which a cutter portion is arranged in a conventional hollow needle 21 as shown in the reference No. 4, so that the position for the cutter portion 70 to be arranged on the hollow needle 21 in the present invention is a position shifted from that of the conventional cutter arranged position with a rotation by 90 degree.

Alternatively, the cutter portion may preferably have a mechanism in that the cutter portion is extended between the inserting head sections 2 each being adjacently arranged with each other in response to the shooting operation for shooting the inserting head sections 2 is carried out and then it is withdrawn from the extended position thereof.

Further, as mentioned above, in the present invention, it is possible to make use of the tag-attaching pin attaching apparatus in which no cutter portion is used.

On the other hand, the length L' of the tag-attaching pin unite pushing member 9, as explained above, should be set at the length so that under the situation at which the tag-attaching pin unite pushing member 9 is the most proximately approached to the opening end portion 48 provided in the first guide section 13, the tip end portion P of the tag-attaching pin unite pushing member 9 can push and arrange the inserting head section 2 of the tag-attaching pin 1 which is located at the most rear end portion of the tag-attaching pin unit 600, to and at the predetermined insertion head portion shooting out position 203.

Another embodiment of the tag-attaching pin attaching apparatus 20 of the present invention will be explained precisely with reference to FIGS. 17 to 24, hereunder.

Figure 17:
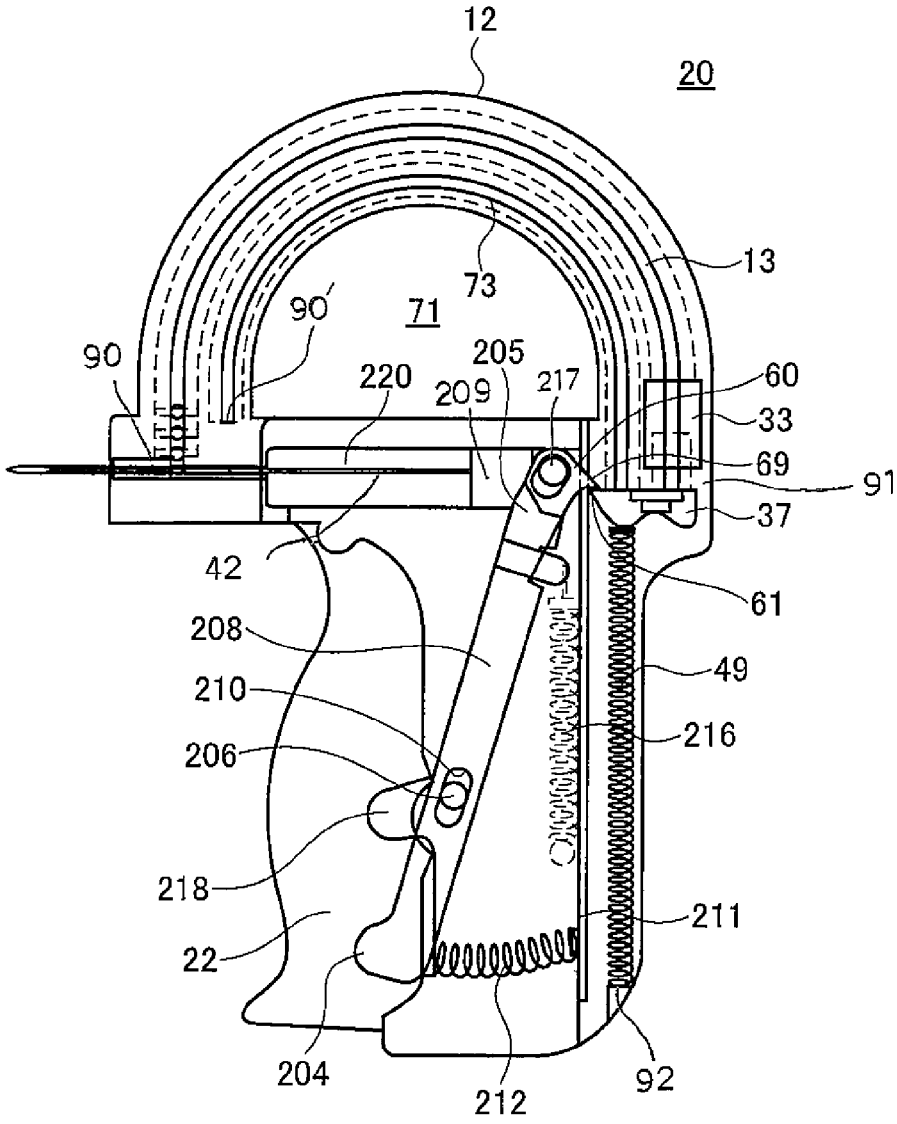
FIG. 17 shows a configuration of a different embodiment of a guide section of the present invention.

Note that, in this embodiment, although the basic configuration of this embodiment is substantially identical to those of the above-mentioned embodiments, the shooting pin mechanism is simplified and the member is provided on a part of the trekking lever which can work in communication with the operation lever 22 as well as the lengths of the first and the second guide sections are set at a value being longer than those of the previous embodiments, as shown in FIG. 17.

In this embodiment, as shown in FIG. 17, the second terminal end portion 91 of the first guide section 13, is arranged at a position below the position at which the pin shooting means 42 is arranged as well as an opening 33 for inserting the tag-attaching pin unit 600 into the first guide section 13 from an external portion of the tag-attaching pin attaching apparatus 20 is provided at a position in the vicinity of the second terminal end portion 91.

By adopting these configurations, it is possible for the tag-attaching pin attaching apparatus 20 to use the tag-attaching pin unit 600 having a long longitudinal length.

On the other hand, the second guide section 73 of this embodiment, is configured so that the second terminal end portion 92 of the second guide section 73 is extended fur below the second terminal end portion 91 of the first guide section 13.

In this embodiment, by adopting this configuration, when a coil spring is used as the pushing drive mechanism 49, since a coil spring having a long length can be used, it is possible to select a coil spring having a large resilient power and simultaneously with this, a closed end portion of the second terminal end portion 92 of the second guide section 73 is configured so that the closed end portion thereof can be optionally either opened or closed.

By doing this in a case when the spring member 49 has been damaged or the resilient force of the spring 49 has been deteriorated, the used spring member 49 can be taken out and can be replaced with a new one by opening the second terminal end portion 92.

On the other hand, in this embodiment, the stopper member 60 is provided on a position at a tip end portion of the tracking lever 208 which can be rotated in communication with a movement of the operation lever 22, and thereby since the engagement formed between the stopping member 60 and the operation member 37 is released just after the operation lever 22 has been driven, the tag-attaching pin unit 600 which is abutted with the tag-attaching pin unite pushing member 9, is moved forward directing to the insertion head portion shooting out position 203 of the tag-attaching pin attaching apparatus 20, inside the first guide portion 13, accompanied by the tag-attaching pin unite pushing member 9.

Figure 18:
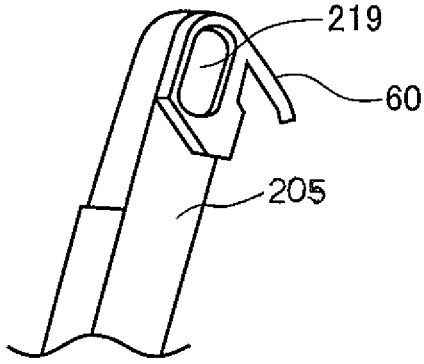
FIG. 18 shows a configuration of a part of a tag-attaching pin shooting mechanism which is used for the different embodiment of a guide section of the present invention.
Figure 18:
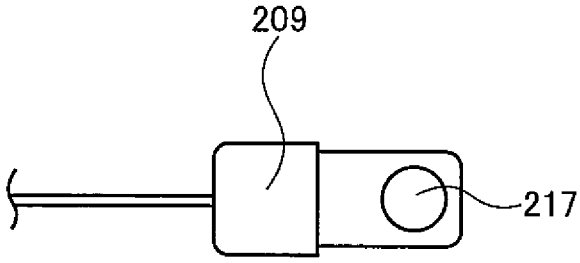
Figure 18:
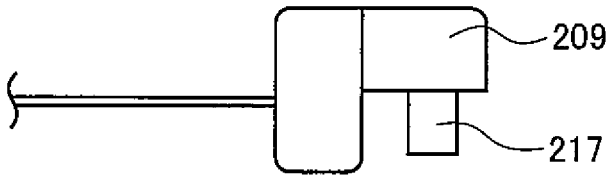
Figure 19:
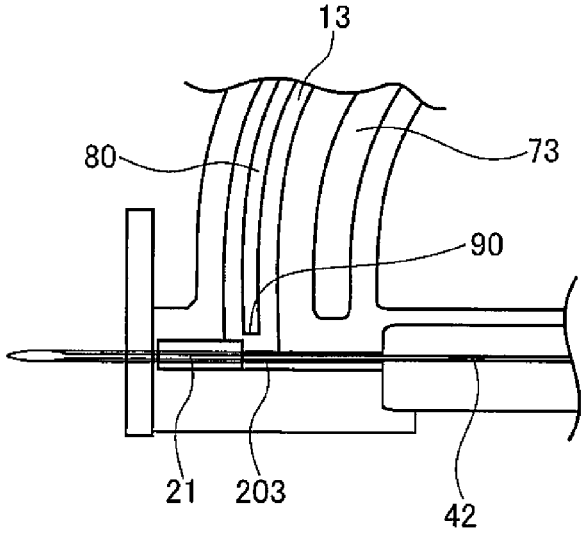
FIG. 19 illustrates a relationship among a first guide section, a second guide section and a tag-attaching pin shooting mechanism as used in further different embodiment of the guide section of the present invention.
Figure 20:
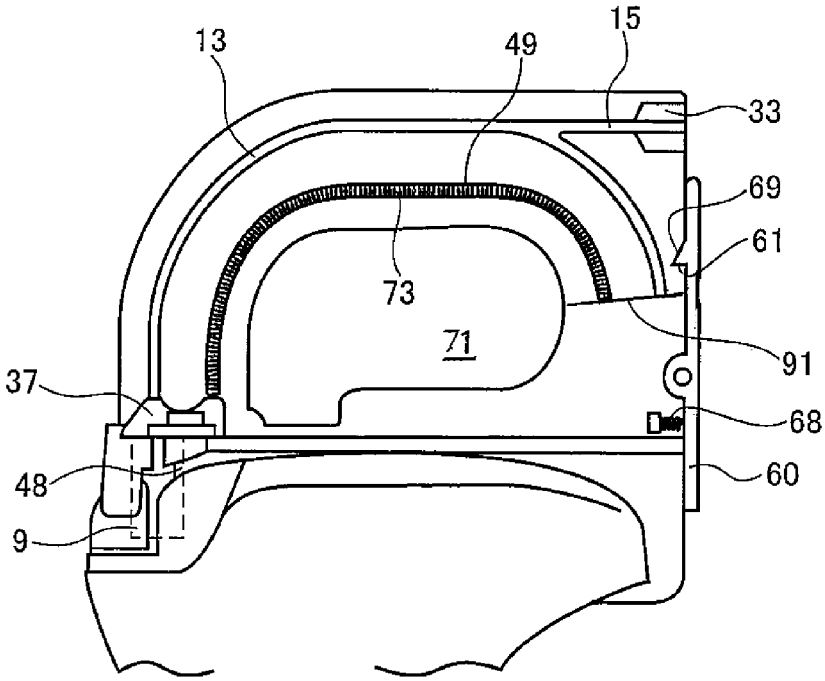
FIG. 20 shows a configuration of a separate embodiment of the guide section of the present invention.

The configuration of the stopper member 60 as arranged at the tip end portion of the tracking lever 208, is not restricted to a specific configuration but one specific embodiment thereof is shown in FIG. 18.

Further, in this embodiment, since the tag-attaching pin attaching apparatus 20 and the guide plate 12 of the present invention are integrally molded with each other previously, as is different from the above-mentioned embodiments, the first terminal end portion 90 of the first guide section 13 can be directly arranged at a position in the vicinity of the insertion head portion shooting out position 203, without utilizing the opening end portion 48.

Accordingly, the length of the front end portion 65 of the tag-attaching pin unite pushing member 9 as used in this embodiment, can be shortened.

And in a case may be, the front end portion 65, per se, can be removed.

Next, the tag-attaching pin shooting mechanism of the tag-attaching pin attaching apparatus 20 will be explained with reference to FIG. 17, hereunder.

Note that, the tag-attaching pin shooting mechanism of the tag-attaching pin attaching apparatus 20 comprises an operation lever 22, a trucking lever 208 and a shooting pin holding member 209 which is connected with the pin shooting means 42 and also a part of which is connected to a part of the trucking lever 28, and thus by the operation of the operation lever 22, the shooting pin holding member 209 is caused to be moved forward so that the tip end portion of the pin shooting means 42 can be projected externally out of the hollow needle 21 by passing through the hollow needle 21.

The trucking lever 208 of the present invention, is pivotally supported by a main portion of the tag-attaching pin attaching apparatus 20 via a pivotal axis 206 and a first end portion of the first end portion 204 of the trucking lever 208 is connected to an inner surface of the operation lever 22.

While, a second end portion 205 of the trucking lever 208 is connected with the shooting pin holding member 209.

Accordingly, by operating the operation lever 22, the shooting pin holding member 209 is moved forward directly to the hollow needle 21.

The connecting portion which is provided at a position in the vicinity of a center portion of the trucking lever 208 as used in the present invention and which is provided on the main portion of the tag-attaching pin attaching apparatus 20, may comprise an opening portion 210 having a major axis along the longitudinal direction of the trucking lever 208.

Further, a spring member 212 which can always give a resilient force to the trucking lever 208, can be provided at a portion between a position in the vicinity of the first end portion 204 of the trucking lever 208 and a part of a portion 211 located in a back side surface of the tag-attaching pin attaching apparatus 20 which is opposite to the tracking lever 208.

On the other hand, in a separate embodiment, a spring member 216 which can always apply an attractive force to the tracking lever 208 can be provided at a portion formed between a position in the vicinity of the second terminal end portion 205 of the tracking lever 208 and a part of a portion 211 located in a back side surface of the tag-attaching pin attaching apparatus 20 which is opposite to the tracking lever 208.

Further, it is also preferable that the shooting pin holding member 209 and the second terminal end portion 205 of the tracking lever 208 are pivotally connected with each other.

For the sake of it, in this embodiment, it is preferable that the second terminal end portion 205 of the tracking lever 208 is provided with an opening portion 219 having a major axis and which can engaged with a projected portion 217 formed on the shooting pin holding member 209.

Further, in this embodiment, it is also preferable that a stopper member 60 which is separately arranged from the tracking lever 208 is provided at the second terminal end portion 205 of the tracking lever 208

By adopting the above-mentioned configuration of the present invention, when an operator starts to perform the tag-attaching pin shooting operation, since the stopper member 60 can be disengaged from the operation member 37 immediately after the operation lever 22 has been operated, without the operator separately performing the operation to disengage the stopper member 60 from the operation member 37, this operation is effective due to the tag-attaching pin unite pushing member 9 immediately getting into a condition for the tag-attaching pin unite pushing member 9 to push the tag-attaching pin unit 600.

On the other hand, a cutout portion having a concaved configuration 218 into which the fixed pivotal axis 206 which can pivotally support the tracking lever 208, can be inserted, is provided at least at a portion of the operation lever 22.

Note that, in this embodiment, at least a part of the shooting pin holding member 209 is configured so that it can move and slide along an inside of a sliding groove section 220 which is horizontally formed an inner wall portion of the tag-attaching pin attaching apparatus 20 and having a center axis being identical to that which penetrating through the hollow needle fixing section 202, the pin shooting means 42 and the insertion head portion shooting out position 203.

Next, a further different embodiment as shown in FIGS. 21 to 24 will be explained with reference to FIGS. 21 to 24, hereunder.

Figure 21:
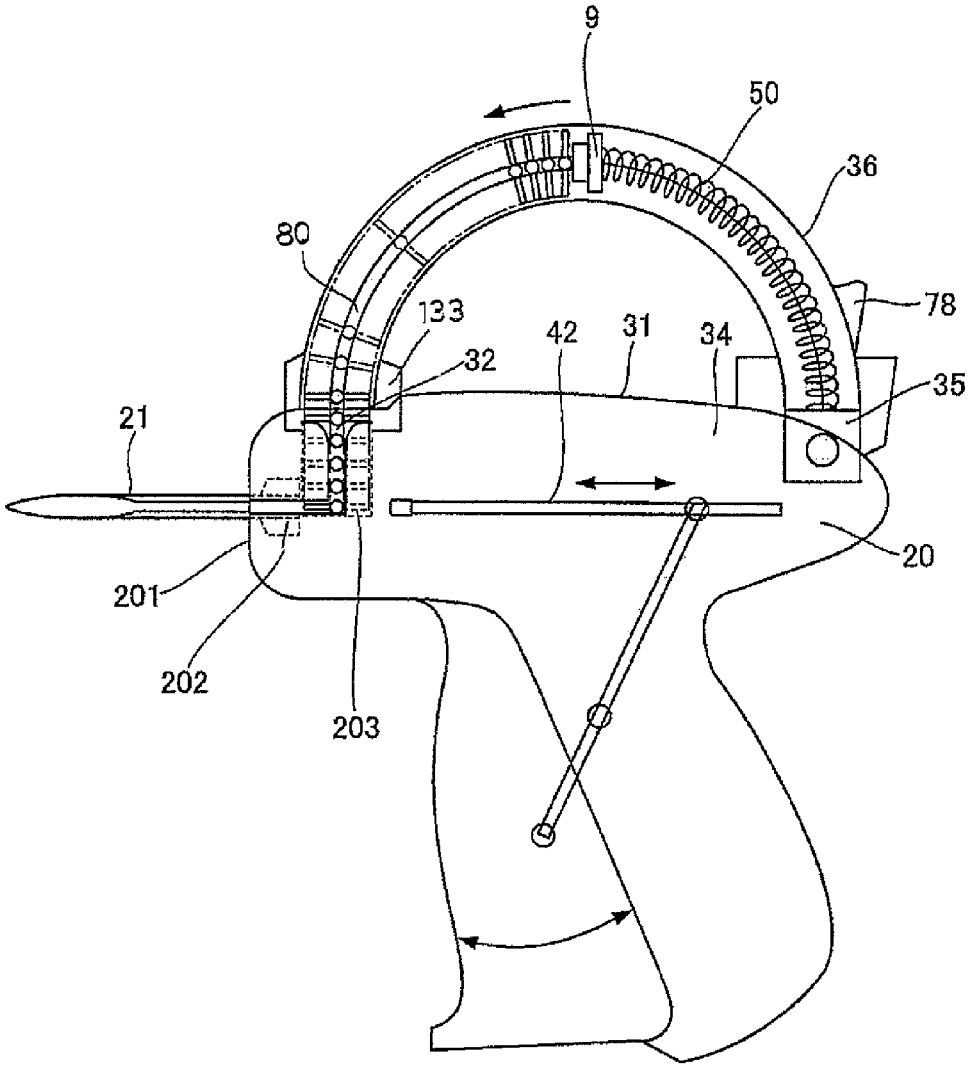
FIG. 21 shown a configuration of a further separate embodiment of the tag-attaching pin attaching apparatus.

FIG. 21 shows the further different embodiment of the present invention, and in FIG. 21, it is shown that a tag-attaching pin attaching apparatus 20 which can use an unit of tag-attaching pins 600 in which a plurality of the tag-attaching pins 1, each comprising a fiber section, an inserting head section 2 and a holding section 3 each being provided at the respective end of a fiber section 4, as shown in FIG. 3, are mutually and parallely arranged with each other, and wherein at least the inserting head sections 2 of each one of the tag-attaching pins 1 which being mutually and adjacently arranged with each other or the holding sections of each one of the tag-attaching pins which being mutually and adjacently arranged with each other, are mutually connected with each other via the connecting members 7 and 8, so that the parallel configuration can be maintained without using the connection bar, wherein a tag is attached to a desired good with the holding section by inserting the inserting head section 2 of the tag-attaching pin 1 into a hollow needle 21 provided on the tag attaching device 20 and by penetrating the inserting head section 2 through the good with pushing the inserting head section 2 out of the hollow needle 21, utilizing a predetermined pin pushing means 42, so as to have the inserting head section 2 attached to a surface of the good with the tag via a part of the good so that the tag is kept by the fiber section 4, and further wherein the tag-attaching pin attaching apparatus 20 being provided with a hollow needle fixing section 202 which can fixedly hold the hollow needle 21 which is arranged at a front end portion 201 of the tag-attaching pin attaching device 20, a shooting pin portion 42 which is positioned at a position opposite to the hollow needle fixing section 202 and can push the inserting head section 2 into the hollow needle 21, and an insertion head portion shooting out position 203 which being arranged at a position between the hollow needle fixing section 202 and the shooting pin portion 42, the tag-attaching pin attaching apparatus 20, wherein a tag-attaching pin unite pushing member 9 which can always give a bias force to one end portion of the tag-attaching pin unit 600 having no connection bar, in a direction facing to the insertion head portion shooting out position 203 under a situation in that another end of the tag-attaching pin unit 600 is arranged at the insertion head portion shooting out position 203.

Further in this embodiment, as shown as shown in FIG. 21, in the tag-attaching pin attaching apparatus 20, a curved guide section 36 is fixedly provided on the upper surface 31 of the tag-attaching pin attaching apparatus 20 and which preferably has a first terminal end portion 133 being provided on a position in the vicinity of an insertion head section inserting groove 32, while has a fixedly arranged second terminal end portion 35 which is fixedly arranged at a position 34 located away from the insertion head section inserting groove 32 formed on the upper surface 31 of the tag-attaching pin attaching apparatus 20, with a predetermined distance.

Figure 22:
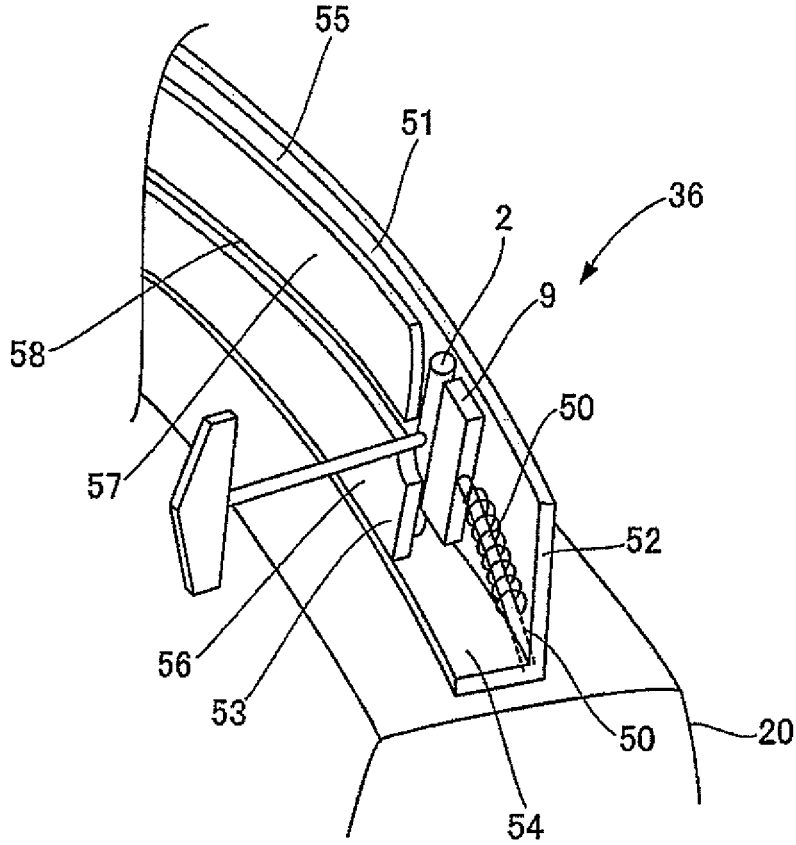
FIG. 22 illustrates a relationship between the first guide section and the second guide section of in the further separate embodiment of the tag-attaching pin attaching apparatus.
Figure 22:
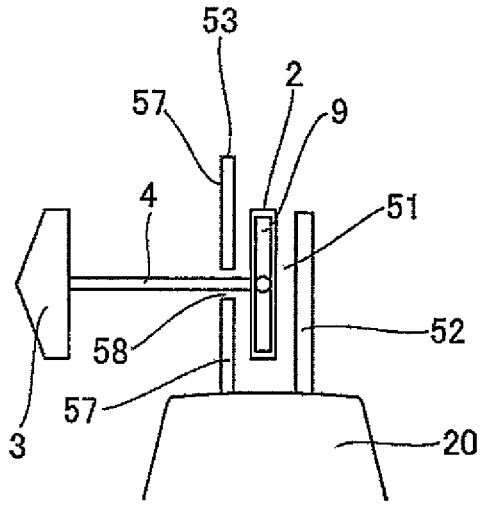

In this embodiment of the present invention, as shown in FIG. 22, the curved guide section 36 is preferably provided with a groove section 51 which is configured so that within the guide section 36, each one of the inserting head sections 2 of the respective tag-attaching pins 1 which comprising the tag-attaching pin unit 600 and the tag-attaching pin unite pushing member 9 which abuts to the inserting head sections 2 arranged at the most rear end portion of the tag-attaching pin unit 600, are commonly able to be moved and slid.

In this embodiment, a configuration of the curved guide section 36 is not restricted to a specific configuration and a length or a curvature thereof can be determined taking a size of the tag-attaching pin attaching apparatus 20 and a configuration of the surface 31, into account.

In this embodiment of the present invention, a driving means 50 which can have the tag-attaching pin unite pushing member 9 to be moved forwardly directing from the second terminal end portion 35 to the first terminal end portion 33 along the curved guide section 36.

On the other hand, as shown in FIG. 22, for example, the curved guide section 36 is provided with the groove section 51 which comprising a first wall member 52 and a second wall member 53 each being oppositely arranged with each other with interposing a predetermined gap therebetween.

In this embodiment, if necessary, the groove section 51 can be provided with a bottom plate 54 and a upper covering member 55.

Further in this embodiment, the curved guide section 36 is provided with the groove section 51 which comprising a first wall member 52 and a second wall member 53 each being oppositely arranged with each other with interposing a predetermined gap through which the insertion head sections 2 can be passed slidably, therebetween, and further, the second wall member 53 preferably comprising an upper second wall member portion 57 and a lower second wall member portion 58 with interposing a predetermined distance through which the fiber sections 4 of the tag-attaching pins 1 can be slidably passed, therebetween.

Figure 23:
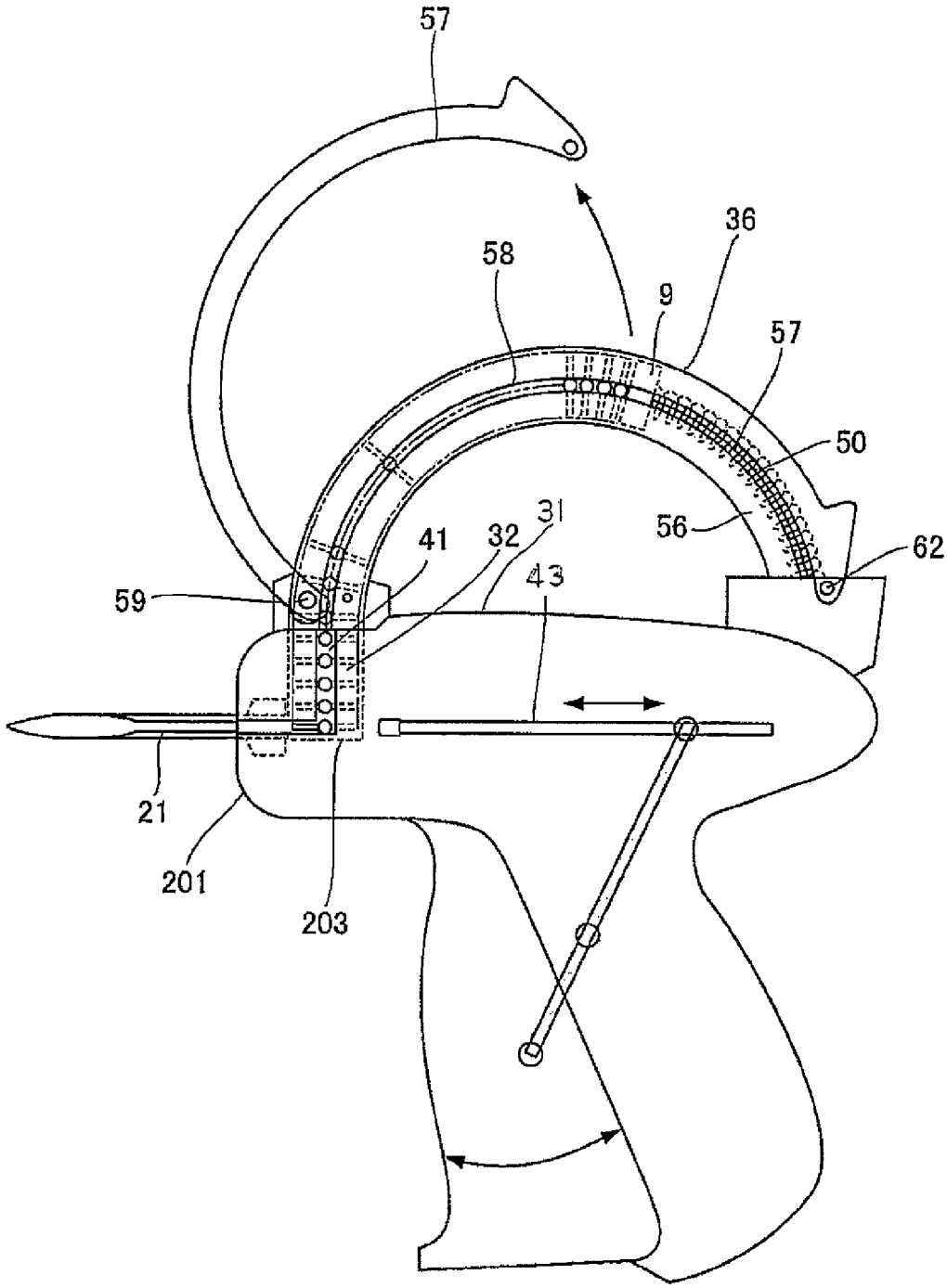
FIG. 23 shows a function of the guide section used for the separate embodiment of the tag-attaching pin attaching apparatus of the present invention.

Further, in this embodiment, in the curved guide section 36, in order to make it easy to insert the insertion head sections 2 of the tag-attaching pin attaching apparatus 20 into the groove portion 51 of the curved guide section 36 as well as to insert the insertion head sections 2 thereof into the insertion head section inserting groove 32 which is provided on an upper surface of the tag-attaching pin attaching apparatus 20, as shown in FIG. 23, the upper second wall member portion 57 which consisting the curved guide section 36, may be configured so as to be displaceable.

Specifically, for example, the upper second wall member portion 57 is configured so that it can be pivotally rotated with the first terminal end portion 133 of the upper second wall member portion 57 being rotated with respect to the axis 59 provided in the tag-attaching pin attaching apparatus 20.

Accordingly, in this embodiment, first of all, when the tag-attaching pin unit 600 is mounted on the tag-attaching pin attaching apparatus 20, the upper second wall member portion 57 of the curved guide section 36 is displaced, as shown in FIG. 23, upwardly, so as to open the groove portion 51 of the curved guide section 36 and then each one of the insertion head section 2 of the respective tag-attaching pin 1 consisting the tag-attaching pin unit 600 is inserted into the groove portion 51 followed by inserting the front end portion of the tag-attaching pin unit 600 is pushed into the insertion head section inserting groove 32 which is provided on the upper surface 31 of the tag-attaching pin attaching apparatus 20 by manually.

Thereafter, by continuing this pushing operation by an operator, a plurality of the fiber sections 4 arranged in the vicinity of the front end portion of the tag-attaching pin unit 600, are inserted into a vertical groove 41 formed vertically on a side surface of the tag-attaching pin attaching apparatus 20, with communication to the insertion head section inserting groove 32 and they are forced to be pushed manually until the insertion head section 2 arrange on the front end portion of the tag-attaching pin unit 600, is reached to insertion head portion shooting out position 203 which is a bottom portion of the insertion head section inserting groove 32 provided on the tag-attaching pin attaching apparatus 20.

After that, the upper second wall member portion 57 of the curved guide section 36, is returned to its original portion and then the free end portion of the upper second wall member portion 57 is fixedly secured with a detachable connecting hold member 62 which is provided at a position in the vicinity of the second terminal end portion 35 being rear end section of the curved guide section 36.

On the other hand, when the upper second wall member portion 57 is displaced, the detachable connecting hold member 62 is released.

Figure 24:
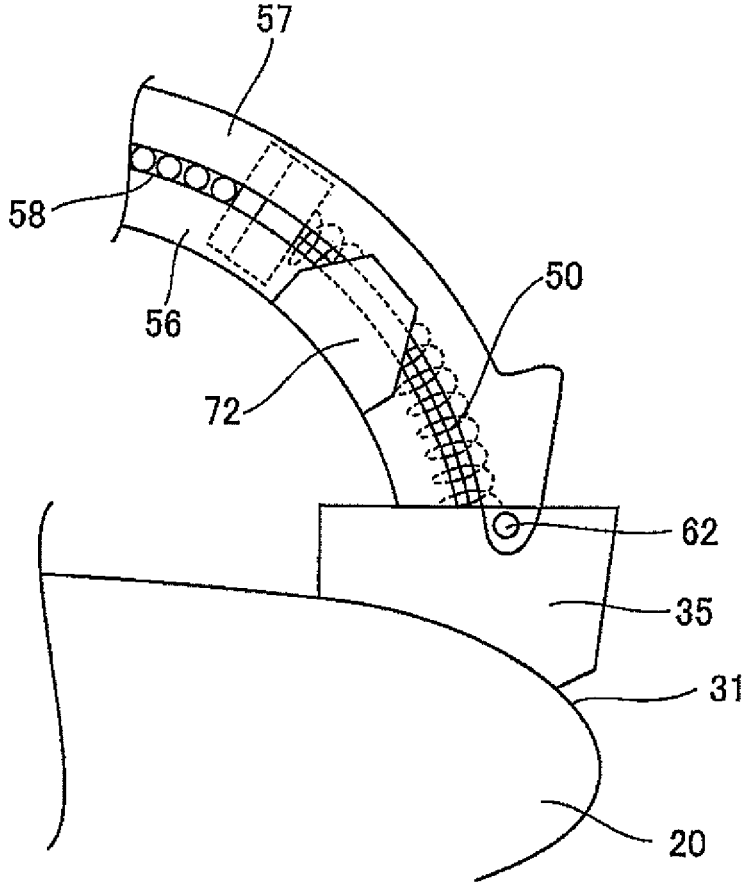
FIG. 24 shows a side view illustrating a precise configuration of the guide section of the separate embodiment of the tag-attaching pin attaching apparatus of the present invention.

Further, in this embodiment, when the upper second wall member portion 57 is returned to its original portion, in order to make this operation easier and to control the ultimately arranged position of the upper second wall member portion 57 to be the predetermined correct position, as shown in FIG. 24, it is preferable that a suitable position controlling member 72 which can be connected with the upper second wall member portion 57 is provided at a suitable position of the lower second wall member portion 56.

Note that, when the upper second wall member portion 57 is returned to its original portion, by performing an operation for guiding the upper second wall member portion 57 so that it is inserted into the groove portion 51 along an inside surface of the position controlling member 72, the upper second wall member portion 57 can be easily returned to the original position.

After that, the tag-attaching pin unit pushing member 9 having a suitable configuration is driven by a suitable driving mechanism 50 thereby the tag-attaching pin unit pushing member 9 is moved and slid along an inside of the groove portion 51.

By doing this, the tag-attaching pin unit pushing member 9 abuts to the insertion head section 2 of the tag-attaching pin 1 arrange on the rear end portion of the tag-attaching pin unit 600 which is already inserted into the groove portion 51 so that the tip end portion of the tag-attaching pin unit 600 always receives a pushing force, i.e., a pressing force which forcing the tip end portion of the tag-attaching pin unit 600 directing to the insertion head portion shooting out position 203 inside the curved guide section 36.

UTILIZATION IN INDUSTRY

A tag-attaching pin attaching apparatus of the present invention can be effectively used for an apparatus in which each one of the tag-attaching pin can be effectively shot out from a tag-attaching pin unit in which a plurality of the tag-attaching pins are arranged in parallelism with each other without using a connection bars, and further, the labels attaching operation can be performed easily with less malfunction of the apparatus.

What is claimed is:

1. A tag-attaching pin attaching apparatus which can use a unit of tag-attaching pins in which a plurality of said tag-attaching pins, each comprising a fiber section, an inserting head section provided at one end of said fiber section, and a holding section provided at another end of said fiber section, are mutually arranged in parallelism with each other, and wherein at least said inserting head sections of each one of said tag-attaching pins which being mutually and adjacently arranged with each other or said holding sections of each one of said tag-attaching pins which being mutually and adjacently arranged with each other, are mutually connected with each other via a connecting member so that said parallel configuration can be maintained without using a connection bar, wherein a tag is attached to a desired good with said holding section by inserting said inserting head section of said tag-attaching pin into a hollow needle provided on said tag-attaching pin attaching apparatus and by penetrating said inserting head section through said good and pushing said inserting head section out of said hollow needle, utilizing a pin pushing means, so as to have said inserting head section attached to a surface of said good with said tag via a part of said good so that said tag is kept by said fiber section, and further wherein said tag-attaching pin attaching apparatus is provided with a hollow needle fixing section which can fixedly hold said hollow needle which is arranged at a front end portion of said tag-attaching pin attaching apparatus, a shooting pin portion which is positioned opposite to said hollow needle fixing section and can push said inserting head section into said hollow needle, and an insertion head portion shooting out position which being arranged at a position between said hollow needle fixing section and said shooting pin portion, said tag-attaching pin attaching apparatus further comprising a guide plate provided with a first guide section for supplying said unit of tag-attaching pins to said insertion head portion shooting out position and which is integrally fixed or detachably connected to a top surface of said tag-attaching pin attaching apparatus and further wherein said first guide section of said guide plate comprises a first end portion which is positioned opposite to said insertion head portion shooting out position and a first groove portion which is extended from said first end portion to a rear end portion of said tag-attaching pin attaching apparatus with a length, having a curved configuration, and further wherein, said first guide section is configured so that said insertion head section and a tag-attaching pin unit pushing member which has a function to push said insertion head section of said tag-attaching pin unit directing to said insertion head portion shooting out position, are slidably inserted therein.

2. A tag-attaching pin attaching apparatus which can use a unit of tag-attaching pins in which a plurality of said tag-attaching pins, each comprising a fiber section, an inserting head section provided at one end of said fiber section, and a holding section provided at another end of said fiber section, are mutually arranged in parallelism with each other, and wherein at least said inserting head sections of each one of said tag-attaching pins which being mutually and adjacently arranged with each other or said holding sections of each one of said tag-attaching pins which being mutually and adjacently arranged with each other, are mutually connected with each other via a connecting member so that said parallel configuration can be maintained, without using a connection bar, wherein a tag is attached to a desired good with said holding section by inserting said inserting head section of said tag-attaching pin into a hollow needle provided on said tag-attaching pin attaching apparatus and by penetrating said inserting head section through said good and pushing said inserting head section out of said hollow needle, utilizing a pin pushing means, so as to have said inserting head section attached to a surface of said good with said tag via a part of said good so that said tag is kept by said fiber section, and further wherein said tag-attaching pin attaching apparatus is provided with a hollow needle fixing section which can fixedly hold said hollow needle which is arranged at a front end portion of said tag-attaching pin attaching apparatus, a shooting pin portion which is positioned opposite to said hollow needle fixing section and can push said inserting head section into said hollow needle, and an insertion head portion shooting out position which is arranged at a position between said hollow needle fixing section and said shooting pin portion, said tag-attaching pin attaching apparatus further comprising a guide plate provided with a first guide section for supplying said unit of tag-attaching pins to said insertion head portion shooting out position and which is integrally fixed or detachably connected to a top surface of said tag-attaching pin attaching apparatus and further wherein said first guide section of said guide plate comprises a first end portion which is positioned opposite to said insertion head portion shooting out position and a first groove portion which is extended from said first end portion to a rear end portion of said tag-attaching pin attaching apparatus with a length, having a curved configuration, and further wherein, said first guide section is configured so that said insertion head section and a tag-attaching pin unit pushing member which has a function to push said insertion head section of said tag-attaching pin unit directing to said insertion head portion shooting out position, are slidably inserted therein, and further wherein said guide plate is provided with a second guide section having a second groove portion which is arranged in close to and in parallelism with said first guide section and having a curved configuration being identical to said first guide section and further a pushing drive member which can push and move said tag-attaching pin unit pushing member within said second guide section is inserted therein with a sliding manner.

3. A tag-attaching pin attaching apparatus according to claim 1 or 2, wherein a second end portion being arranged in opposite to said first end portion of said first guide section is closed and further an opening portion through which said inserting head section of said tag-attaching pin unit can be inserted into said first guide section, is provided at a position around said second end portion of said first guide section, directly, or at a position around an end portion of a third guide section which is connected to said first guide section.

4. A tag-attaching pin attaching apparatus according to claim 3, wherein said first end portion of said second guide section is directing to a position of said insertion head portion shooting out position, and wherein said second end portion of said second guide section is directing to a position of said second end portion of said first guide section.

5. A tag-attaching pin attaching apparatus according to claim 3, wherein, said opening portion is provided at a position so that said inserting head section of said tag-attaching pin unit which is to be inserted into said first guide section, is inserted therein at a position in front of said tag-attaching pin unit pushing member with respect to a pushing direction of said tag-attaching pin unit pushing member.

6. A tag-attaching pin attaching apparatus according to claim 3, wherein, in a case when said guide plate is detachably mounted on said tag-attaching pin attaching apparatus, both of said second end portions of said first and second guide sections are arranged at a position directing to a connecting section formed between said guide plate and a rear end portion of said tag-attaching pin attaching apparatus.

7. A tag-attaching pin attaching apparatus according to claim 3, wherein, in a case when said guide plate is integrally mounted on said tag-attaching pin attaching apparatus, both of said second end portions of said first and second guide sections are extended to a position located beneath an upper edge surface of said tag-attaching pin attaching apparatus or beneath said insertion head portion shooting out position.

8. A tag-attaching pin attaching apparatus according to claim 3, wherein, said tag-attaching pin unit pushing member which can slide along inside of said first guide section is always applied with a bias force so that said tag-attaching pin unit pushing member can abut on said inserting head section arranged at the most rear end portion of said tag-attaching pin unit which has been inserted into said first guide section and can slide in said first guide section with pushing said over all tag-attaching pin unit directing to said first end portion of said first guide section.

9. A tag-attaching pin attaching apparatus according to claim 8, wherein, at least when said tag-attaching pin unit is inserted into said first guide section, said tag-attaching pin unit pushing member is engaged with a stopper member at a position proximate said second end portion of said first guide section so that said tag-attaching pin unit pushing member is suspended at said position against to said bias force.

10. A tag-attaching pin attaching apparatus according to claim 9, wherein, said stopper member is provided on said guide plate or provided on a part of a tracking lever operating in connection with an operation lever used for said tag-attaching pin attaching apparatus.

11. A tag-attaching pin attaching apparatus according to claim 3, wherein, said first guide section is also provided with a first slit portion through which said fiber section of said tag-attaching pin included in said tag-attaching pin unit can pass and slide.

12. A tag-attaching pin attaching apparatus according to claim 11, wherein, said tag-attaching pin unit pushing member moving within said first guide section with sliding manner, is provided with an operating member which is connected to a first connecting member externally extended from said first slit portion so that said operating member can be slidably moved integrally with said tag-attaching pin unit pushing member along an outer surface of said first guide section.

13. A tag-attaching pin attaching apparatus according to claim 11, wherein, said operating member is further connected to a second connecting member which is externally extended from said pushing drive member which can slidably move within said second guide section, through said second slit portion of said second guide section.

14. A tag-attaching pin attaching apparatus according to claim 13, wherein, said tag-attaching pin unit pushing member which can slidably move within said first guide section, is applied with a driving force generated from said pushing drive member driven within said second guide section by a driving means via said second connecting member, said operating member and said first connecting member.

15. A tag-attaching pin attaching apparatus according to claim 3, wherein, a driving mechanism which can drive said pushing drive member is provided at said second end portion of said second guide section or at a position proximate said second end portion thereof.

16. A tag-attaching pin attaching apparatus according to claim 15, wherein, said driving mechanism arranged inside of said second guide section comprises a mechanical mechanism utilizing a spring force, a fluid force, an electrical energy or a magnetic energy.

17. A tag-attaching pin attaching apparatus according to claim 14, wherein, in a case when said driving mechanism comprises said spring member, said pushing drive member is configured so that said pushing drive member is applied in said second guide section, with a bias force by said spring member arranged between said pushing drive member and said closed second end portion of said second guide section.

18. A tag-attaching pin attaching apparatus according to claim 17, wherein, said spring member can be inserted into and taken out from said opened second end portion of said second guide section by releasing said closed condition of said second end portion of said second guide section.

19. A tag-attaching pin attaching apparatus according to claim 12, wherein, said tag-attaching pin unit pushing member is rotatably engaged with said operating member.

20. A tag-attaching pin attaching apparatus according to claim 3, wherein, said tag-attaching pin unit pushing member comprises a main body portion and a front end portion which can abut to said insertion head section of said tag-attaching pin, provided at the most rear end portion of said tag-attaching pin unit and wherein said front end portion has a rectangular cross-section.

21. A tag-attaching pin attaching apparatus according to claim 20, wherein, a tip end portion P of said front end portion of said tag-attaching pin unit pushing member is extended forwardly from said main body portion of said tag-attaching pin unit pushing member by a length L corresponding to a length formed between an opening portion of an insertion head section inserting groove provided on an upper surface of said tag-attaching pin attaching apparatus and said insertion head portion shooting out position.

22. A tag-attaching pin attaching apparatus according to claim 3, wherein, a tag-attaching pin shooting mechanism of said tag-attaching pin attaching apparatus comprises said operating member, a tracking lever member which can pivotally move with engaging with said operating member at a position inside said tag-attaching pin attaching apparatus, a shooting pin portion holding means which being connected to said shooting pin portion and a part of which being connected to a part of said tracking lever member, and wherein, said shooting pin portion holding means is configured so that by operating said operation lever, a tip end portion of said shooting pin portion can be projected outwardly from said hollow needle by passing through said hollow needle.

23. A tag-attaching pin attaching apparatus according to claim 1, wherein, said tracking lever is pivotally supported on a main body of said tag-attaching pin attaching apparatus, at a position proximate a center portion thereof, while a first end portion of said tracking lever portion being connected to an inside surface of said operating member, whereby said shooting pin portion holding means can be moved forwardly in a direction to said hollow needle fixing section in response to an operation of said operation lever.

24. A tag-attaching pin attaching apparatus according to claim 22, wherein, a connecting portion which is provided on a portion proximate a center portion of said tracking lever and which engages with a fixed supporting rod provided on said main body of said tag-attaching pin attaching apparatus, is provided with an opening section which having a major axis along with a longitudinal direction of said tracking lever.

25. A tag-attaching pin attaching apparatus according to claim 23, wherein, a spring member is provided at a position formed between a position in the vicinity of said first end portion of said tracking lever and a part of a back side surface of a portion opposite to said operating lever of said tag-attaching pin attaching apparatus so that a permanent resilient force can be applied to said tracking lever.

26. A tag-attaching pin attaching apparatus according to claim 23, wherein, a spring member is provided at a position formed between a position in the vicinity of said second end portion of said tracking lever and a part of a back side surface of a portion opposite to said operating lever of said tag-attaching pin attaching apparatus so that a permanent attractive force can be applied to said tracking lever.

27. A tag-attaching pin attaching apparatus according to claim 22, wherein, said shooting pin portion holding means and said second end portion of said tracking lever are pivotally connected with each other.

28. A tag-attaching pin attaching apparatus according to claim 27, wherein a second end portion of said tracking lever is provided with an opening section which can engage with a connecting projection portion provided on said shooting pin portion holding means, and said open section having a major axis formed along with a center axis of said tracking lever.

29. A tag-attaching pin attaching apparatus according to claim 22, wherein, a concaved cut out portion to which said fixed supporting rod for supporting said tracking lever is inserted, is provided on at least a portion of said operating lever.

30. A tag-attaching pin attaching apparatus according to claim 9, wherein, a stopper member which can temporarily stop said sliding movement of said operating member is provided on said second end portion of said tracking lever.

31. A tag-attaching pin attaching apparatus according to claim 30, wherein, said stopper member is provided with a stopper engaging member which can engage with a part of said operating member when said operating lever is back to a situation just before the operation will be started.

32. A tag-attaching pin attaching apparatus according to claim 31, wherein, said stopper member is configured so that the engagement formed between said stopper member and said operating lever will be released at a time just after said operating lever has started its operation or just before said operating lever will start its operation.

33. A tag-attaching pin attaching apparatus according to claim 22, wherein, at least a part of said shooting pin portion holding means is configured so that it can be slidably moved within said sliding groove section which is horizontally arranged on an inside surface of said tag-attaching pin attaching apparatus and said sliding groove section having a center axis which is coaxial with center axes of said hollow needle fixing section of said shooting pin portion and of said insertion head portion shooting out position, with each other.

* * * * *